US011059255B2

(12) United States Patent
Walsh

(10) Patent No.: US 11,059,255 B2
(45) Date of Patent: Jul. 13, 2021

(54) METHOD AND SYSTEM FOR FORMING PACKAGES

(71) Applicant: Graphic Packaging International, Inc., Atlanta, GA (US)

(72) Inventor: Joseph C. Walsh, Boulder, CO (US)

(73) Assignee: Graphic Packaging International, LLC, Atlanta, GA (US)

( * ) Notice: Subject to any disclaimer, the term of this patent is extended or adjusted under 35 U.S.C. 154(b) by 540 days.

(21) Appl. No.: 15/209,013

(22) Filed: Jul. 13, 2016

(65) Prior Publication Data

US 2017/0015079 A1 Jan. 19, 2017

Related U.S. Application Data

(60) Provisional application No. 62/231,723, filed on Jul. 14, 2015.

(51) Int. Cl.
*B31D 5/00* (2017.01)
*B65D 33/02* (2006.01)
(Continued)

(52) U.S. Cl.
CPC ..... *B31D 5/0004* (2013.01); *B31B 70/008* (2017.08); *B65D 5/3628* (2013.01);
(Continued)

(58) Field of Classification Search
CPC .... B31D 5/0004; B31D 5/606; B31D 5/3628; B31B 50/64; B31B 70/001; B31B 70/008;
(Continued)

(56) References Cited

U.S. PATENT DOCUMENTS 1,474,088 A 11/1923 Reynolds
1,516,090 A 11/1924 Gary et al.
(Continued)

FOREIGN PATENT DOCUMENTS

CA 2 384 311 3/2001
CA 2 586 472 5/2006
(Continued)

OTHER PUBLICATIONS

Office Action for Chinese Application No. 201680024662.X dated Nov. 1, 2018, with English translation.
(Continued)

*Primary Examiner* — Thanh K Truong
*Assistant Examiner* — David G Shutty
(74) *Attorney, Agent, or Firm* — Womble Bond Dickinson (US) LLP

(57) ABSTRACT

A system and method of at least partially forming reinforced packages. The method comprises moving a web of material in a downstream direction through a web forming section, at least partially forming at least a bag portion in the web of material during the moving the web of material through the web forming section, forming an attached web by adhering a construct to the bag portion of the web of material, and moving the attached web through a separating station. The moving the attached web can comprise moving the construct with the web of material. The method further can comprise separating the bag portion from a remainder of the web of material to form a bag during the moving the attached web through the separating station, the bag being attached to the construct.

26 Claims, 16 Drawing Sheets

(51) Int. Cl.

| | |
|---|---|
| ***B65D 5/36*** | (2006.01) |
| ***B65D 5/60*** | (2006.01) |
| ***B31B 70/00*** | (2017.01) |
| *B31B 160/20* | (2017.01) |
| *B31B 70/64* | (2017.01) |
| *B31B 70/81* | (2017.01) |
| *B31B 70/26* | (2017.01) |
| *B31B 70/10* | (2017.01) |
| *B31B 155/00* | (2017.01) |
| *B31B 50/62* | (2017.01) |
| *B31B 170/10* | (2017.01) |
| *B31B 50/04* | (2017.01) |
| *B31B 70/14* | (2017.01) |

(52) U.S. Cl.

CPC ..... *B65D 5/606* (2013.01); *B31B 50/042* (2017.08); *B31B 50/624* (2017.08); *B31B 70/10* (2017.08); *B31B 70/146* (2017.08); *B31B 70/262* (2017.08); *B31B 70/266* (2017.08); *B31B 70/645* (2017.08); *B31B 70/649* (2017.08); *B31B 70/8122* (2017.08); *B31B 2155/0014* (2017.08); *B31B 2160/20* (2017.08); *B31B 2170/10* (2017.08)

(58) Field of Classification Search

CPC ..... B31B 70/022; B31B 70/14; B31B 70/16; B31B 70/26; B31B 70/36; B31B 70/62; B31B 70/64; B31B 70/79; B31B 70/146; B31B 70/649; B65D 5/3628; B65D 5/606; B65D 2120/25

USPC ... 493/93, 98, 100, 104, 105, 107, 108, 110, 493/11, 128, 133

See application file for complete search history.

(56) References Cited

U.S. PATENT DOCUMENTS 1,664,111 A 3/1928 Johnson
2,092,858 A 9/1937 Richard
2,095,910 A * 10/1937 Bergstein ..... B31B 50/00 493/98
2,099,257 A * 11/1937 Bergstein ..... B65D 5/606 229/117.32
2,107,946 A 2/1938 Inman
2,114,625 A 4/1938 Bergstein
2,134,057 A 10/1938 Potdevin
2,132,966 A 11/1938 O'Brien
2,166,388 A * 7/1939 Bergstein ..... B31B 50/00 493/98
2,197,113 A 4/1940 Piazze
2,250,249 A * 7/1941 Bergstein ..... B65D 5/606 229/117.32
2,273,470 A * 2/1942 Gardner ..... B65D 5/56 493/332
2,282,207 A 5/1942 Palmer
2,286,465 A 6/1942 Clement
RE23,096 E 4/1949 Mullinix
2,502,117 A * 3/1950 Anderson ..... B31B 50/00 493/18
2,553,923 A 5/1951 Lambert
2,758,520 A 8/1956 Hepworth
2,799,211 A 7/1957 Zerlin
2,835,435 A * 5/1958 Mullinix ..... B65D 5/0263 229/87.05
2,870,023 A 1/1959 Vogt
2,913,161 A 11/1959 Travis
2,987,402 A 6/1961 Dold
3,104,596 A 9/1963 Bergstein
3,105,417 A 10/1963 Hammer
3,142,231 A 7/1964 Christensson
3,142,430 A 7/1964 Meyers
3,153,991 A 10/1964 Goodrich
3,194,471 A 7/1965 Murphy
3,218,961 A 11/1965 Kraft et al.
3,240,419 A 3/1966 Spiering et al.
3,249,286 A 5/1966 Palmer
3,250,454 A 5/1966 Steiger
3,272,423 A 9/1966 Bjarno
3,324,998 A 6/1967 Farquhar
3,336,846 A 8/1967 Berghgracht
3,357,631 A 12/1967 Aid et al.
3,395,623 A * 8/1968 Baker ..... B65B 3/025 53/449
3,399,818 A 9/1968 Stegner
3,412,925 A 11/1968 Booth
3,428,235 A 2/1969 Randazzo
3,459,357 A 8/1969 Egger et al.
3,461,642 A 8/1969 Langen et al.
3,482,758 A 12/1969 Pierre
3,515,333 A 6/1970 Kotkas et al.
3,543,469 A 12/1970 Ullman
3,552,640 A 1/1971 Young
3,554,434 A 1/1971 Anderson
3,570,751 A 3/1971 Trewella
3,575,409 A 4/1971 Calvert
3,576,290 A 4/1971 Marchisen
3,616,027 A 10/1971 Honsel
3,627,541 A 12/1971 Farquhar
3,637,130 A 1/1972 Farquhar
3,659,777 A 5/1972 Kanada et al.
3,739,545 A 6/1973 Lattke
3,800,677 A 4/1974 Jones et al.
3,878,771 A * 4/1975 Malcolm ..... B65D 5/70 493/67
RE28,554 E 9/1975 Curler et al.
3,945,870 A 3/1976 Johnsen
3,959,950 A 6/1976 Fukuda
3,964,669 A 6/1976 Sontag et al.
3,981,494 A 9/1976 Prestegaard
4,011,983 A 3/1977 Greene
4,034,658 A 7/1977 Sherman
4,082,216 A 4/1978 Clarke
4,164,171 A 8/1979 Meyers et al.
4,170,928 A 10/1979 Beasley
4,196,035 A 4/1980 Reil
4,228,945 A 10/1980 Wysocki
4,244,281 A 1/1981 Kauffman et al.
4,267,955 A 5/1981 Struble
4,284,205 A 8/1981 Hirata
4,312,451 A 1/1982 Forbes, Jr.
4,313,542 A 2/1982 Roberts et al.
4,331,434 A 5/1982 Buschor
4,398,636 A 8/1983 Baxter
4,457,483 A 7/1984 Gagne
4,477,014 A 10/1984 Brandenburger
4,478,351 A 10/1984 Homma
4,484,683 A 11/1984 Werner, Jr.
4,490,960 A 1/1985 Klemesrud
4,494,785 A 1/1985 Song
4,520,615 A 6/1985 Engler
457,746 A * 3/1986 Tokuno ..... B65H 29/6627 198/462.2
4,575,000 A 3/1986 Gordon et al.
4,577,746 A * 3/1986 Tokuno ..... B65H 29/6627 198/462.2
4,578,929 A 4/1986 Tisma
4,582,315 A 4/1986 Scarpa et al.
4,600,346 A 7/1986 Podosek
4,605,464 A 8/1986 Slevin
4,608,259 A 8/1986 Cortopassi
4,627,223 A * 12/1986 Janhonen ..... B65D 75/38 53/449
4,726,170 A * 2/1988 Sawa ..... B65B 43/30 53/386.1
4,747,703 A 5/1988 Cazes
4,754,914 A 7/1988 Wischusen, III
4,775,771 A 10/1988 Pawlowski
4,785,696 A 11/1988 Martiny
4,793,117 A 12/1988 Raudat et al.
4,802,664 A 2/1989 Larsen

(56) References Cited

U.S. PATENT DOCUMENTS 4,854,983 A * 8/1989 Bryniarski et al. ..... B29C 65/18 156/70
4,865,921 A 9/1989 Hollenberg
4,881,934 A 11/1989 Harston et al.
4,890,439 A 1/1990 Smart
4,919,785 A 4/1990 Willey et al.
4,930,639 A 6/1990 Rigby
4,936,935 A 6/1990 Beckett
4,940,200 A 7/1990 Sawyer
4,963,424 A 10/1990 Beckett
4,986,522 A 1/1991 Paulson
4,995,217 A 2/1991 Francis, Jr.
5,014,582 A * 5/1991 Teik ..... B65H 29/16 493/362
5,019,029 A 5/1991 Calvert
5,028,147 A 7/1991 Graham
5,034,234 A 7/1991 Andreas et al.
5,071,062 A 12/1991 Bradley et al.
5,078,273 A 1/1992 Kuchenbecker
5,080,643 A 1/1992 Mitchell et al.
5,093,364 A 3/1992 Richards
5,096,723 A 3/1992 Turpin
5,097,651 A 3/1992 Decottignies et al.
5,102,385 A 4/1992 Calvert
5,102,485 A 4/1992 Keeler et al.
5,108,355 A * 4/1992 Walsh ..... B31B 50/00 493/110
5,117,078 A 5/1992 Beckett
5,132,124 A 7/1992 Tamaki et al.
5,154,041 A 10/1992 Schneider
5,175,404 A 12/1992 Andreas et al.
5,176,612 A 1/1993 Calvert et al.
5,199,792 A 4/1993 Roosa
5,205,651 A 4/1993 Decottignies et al.
5,207,629 A 5/1993 Walsh
5,213,902 A 5/1993 Beckett
5,221,419 A 6/1993 Beckett
5,224,919 A * 7/1993 Walsh ..... B31B 50/00 493/110
5,242,365 A 9/1993 Counts
5,254,071 A * 10/1993 Laroche ..... B65H 3/42 271/106
5,260,537 A 11/1993 Beckett
5,266,386 A 11/1993 Beckett
5,282,349 A 2/1994 Siegel
5,282,528 A 2/1994 Hudson
5,326,022 A 7/1994 Green
5,330,099 A 7/1994 Beales et al.
RE34,683 E 8/1994 Maynard
5,337,951 A 8/1994 Roccaforte
5,340,436 A 8/1994 Beckett
5,346,311 A 9/1994 Siler et al.
5,354,973 A 10/1994 Beckett
5,410,135 A 4/1995 Pollart
5,411,165 A 5/1995 Ellis
5,424,517 A 6/1995 Habeger
5,427,267 A 6/1995 Willman
5,484,100 A 1/1996 Rigby
5,492,269 A 2/1996 Sung
5,510,132 A 4/1996 Gallo, Jr.
5,519,195 A 5/1996 Keefer
5,585,027 A 12/1996 Young
5,615,795 A 4/1997 Tipps
5,628,921 A 5/1997 Beckett
5,632,368 A 5/1997 Moncrief
5,653,671 A 8/1997 Reuteler
5,657,610 A 8/1997 Dietrich et al.
5,662,577 A 9/1997 Reuteler
5,672,407 A 9/1997 Beckett
5,688,427 A 11/1997 Gallo, Jr.
5,746,871 A 5/1998 Walsh
5,759,422 A 6/1998 Schmelzer
5,772,569 A 6/1998 Janhonen
5,800,724 A 9/1998 Habeger
5,845,769 A 12/1998 Yeager
5,876,319 A 3/1999 Holton
5,921,681 A 7/1999 Money
5,938,110 A 8/1999 Bernstein
5,964,161 A 10/1999 Conway
5,997,458 A 12/1999 Guttinger et al.
6,050,063 A 4/2000 Ford et al.
6,063,415 A 5/2000 Walters
6,073,423 A 6/2000 House
6,082,613 A 7/2000 Mikulski et al.
6,114,679 A 9/2000 Lai
6,132,351 A 10/2000 Lotto et al.
6,139,662 A 10/2000 Forman
6,146,028 A 11/2000 Preszler
6,150,646 A 11/2000 Lai et al.
6,204,492 B1 3/2001 Zeng et al.
6,206,279 B1 3/2001 Countee
6,213,286 B1 4/2001 Hunter et al.
6,234,384 B1 5/2001 Capy et al.
6,251,451 B1 6/2001 Zeng
6,254,519 B1 7/2001 Toshima
6,311,457 B1 11/2001 May et al.
6,312,742 B1 11/2001 Wood et al.
6,332,488 B1 12/2001 Walsy
6,335,042 B1 1/2002 Money
6,349,874 B1 2/2002 Hill
6,360,941 B1 3/2002 Larsson
6,398,010 B1 * 6/2002 Fangmeier ..... B65H 29/6618 198/460.3
6,401,927 B1 6/2002 Sorensen et al.
6,414,290 B1 7/2002 Cole
6,425,847 B1 7/2002 Broenstrup
6,431,365 B1 8/2002 Money
6,433,322 B2 8/2002 Zeng et al.
6,455,827 B2 9/2002 Zeng
6,490,843 B1 12/2002 May
6,494,619 B1 12/2002 Sulpizio
6,509,052 B1 1/2003 Benham et al.
6,550,608 B1 4/2003 Brown et al.
6,552,315 B2 4/2003 Zeng et al.
6,635,139 B2 * 10/2003 Bohn ..... B29C 65/18 156/251
6,637,646 B1 * 10/2003 Muise ..... B65D 5/606 229/117.01
6,657,165 B1 * 12/2003 Makutonin ..... B29C 65/18 156/583.1
6,676,583 B2 1/2004 Walsh
6,677,563 B2 1/2004 Lai
6,683,289 B2 1/2004 Whitmore et al.
6,695,202 B2 2/2004 Miess
6,702,178 B2 3/2004 Bowers et al.
6,717,121 B2 4/2004 Zeng
6,744,028 B2 6/2004 Chisholm et al.
6,765,182 B2 7/2004 Cole
6,854,639 B2 2/2005 Walsh
6,869,387 B2 3/2005 Post et al.
6,915,829 B2 7/2005 Popp
6,948,293 B1 9/2005 Eckermann
6,986,920 B2 1/2006 Forman et al.
6,993,889 B2 2/2006 Ford et al.
7,019,271 B2 3/2006 Wnek et al.
7,070,551 B2 7/2006 Lasson
7,143,930 B2 12/2006 Money et al.
7,414,230 B2 8/2008 Fitzwater
7,445,590 B2 * 11/2008 Selle ..... B29C 65/10 493/200
7,461,838 B2 12/2008 Hendricks et al.
7,473,875 B2 1/2009 Fitzwater
7,509,789 B2 3/2009 Scholtes et al.
7,510,515 B2 3/2009 Ichikawa
7,604,155 B2 10/2009 Bossel et al.
7,667,167 B2 2/2010 Fitzwater
7,695,421 B2 4/2010 Ford
7,699,214 B2 4/2010 Mestre et al.
7,794,147 B2 9/2010 Perelman
7,819,583 B2 10/2010 Walker et al.
7,837,606 B2 11/2010 Tetenborg et al.
7,893,389 B2 2/2011 Fitzwater
7,913,897 B2 3/2011 Manaige

(56) References Cited

U.S. PATENT DOCUMENTS 7,935,041 B2 5/2011 Graham et al.
7,938,312 B2 5/2011 Ford
7,959,060 B2 6/2011 Wilson et al.
7,982,167 B2 7/2011 Fitzwater
7,984,844 B2 7/2011 Jones
8,013,280 B2 9/2011 Robison et al.
8,024,910 B2 9/2011 Graham et al.
8,025,618 B2 9/2011 Walsh et al.
8,066,137 B2 11/2011 Sanfilippo et al.
8,142,077 B2 3/2012 Iannelli, II et al.
8,196,805 B2 6/2012 Brand et al.
8,206,033 B2 6/2012 Sato et al.
8,226,794 B2 7/2012 Fogle
8,309,896 B2 11/2012 Fitzwater
8,317,671 B1 11/2012 Zoeckler
8,323,165 B2 12/2012 Atoui
8,403,819 B2 3/2013 Zoeckler
8,403,820 B2 3/2013 Zoeckler
8,468,782 B2 6/2013 Michalsky et al.
8,474,163 B2 7/2013 Rubin
8,479,972 B2 7/2013 Craft
8,500,330 B2 8/2013 Nomura et al.
8,579,780 B2 11/2013 Senbo
8,672,214 B2 3/2014 Manaige
8,727,204 B2 5/2014 Burke
8,826,959 B2 9/2014 Files et al.
8,870,519 B2 10/2014 Karst
8,961,380 B2 2/2015 Langen
9,050,770 B1 6/2015 Russell
9,073,659 B2 7/2015 Smith
9,108,761 B2 8/2015 Fitzwater et al.
9,113,648 B2 8/2015 Burke
9,156,579 B2 10/2015 Pinkstone
9,156,582 B2 10/2015 Walsh et al.
9,238,343 B2 * 1/2016 Selle ..... B29C 66/81431
9,346,234 B2 5/2016 Hajek et al.
9,346,582 B2 5/2016 Pinkstone
9,463,896 B2 10/2016 Fitzwater
9,522,499 B2 12/2016 Files et al.
9,663,320 B2 * 5/2017 Wittmann ..... B65H 33/00
9,758,275 B2 9/2017 Fitzwater et al.
10,023,349 B2 7/2018 Fitzwater
10,173,805 B2 1/2019 Waddington
10,737,824 B2 8/2020 Fitzwater
2002/0041067 A1 4/2002 Muller
2002/0148882 A1 10/2002 Bowers
2003/0002755 A1 1/2003 Kim et al.
2003/0080120 A1 5/2003 Whitmore et al.
2003/0144121 A1 7/2003 Walsh
2003/0185948 A1 10/2003 Garwood
2003/0197051 A1 * 10/2003 Muise ..... B65D 5/606
229/117.32
2003/0206997 A1 11/2003 Winkelman et al.
2004/0004111 A1 1/2004 Cardinale
2004/0016216 A1 1/2004 Romagnoli
2004/0074947 A1 4/2004 Hillebrand
2004/0101605 A1 5/2004 Sigel
2004/0206049 A1 10/2004 Hiramoto et al.
2005/0014623 A1 1/2005 Van De Kruys
2005/0124478 A1 6/2005 Scholtes et al.
2005/0272583 A1 12/2005 Totani
2005/0284865 A1 12/2005 Fogle et al.
2006/0009339 A1 1/2006 Sleight et al.
2006/0027303 A1 2/2006 Hunter
2006/0037290 A1 2/2006 Smith
2006/0049190 A1 3/2006 Middleton
2006/0096978 A1 5/2006 Lafferty et al.
2006/0113300 A1 6/2006 Wnek et al.
2006/0191929 A1 8/2006 Berg, Jr. et al.
2007/0131742 A1 6/2007 Fitzwater
2007/0131743 A1 6/2007 Fitzwater
2007/0131744 A1 6/2007 Fitzwater
2007/0131745 A1 6/2007 Fitzwater
2007/0137222 A1 6/2007 Kastanek et al.
2007/0138247 A1 6/2007 Fitzwater
2007/0151888 A1 7/2007 Bossel et al.
2007/0267466 A1 11/2007 Brand et al.
2008/0067225 A1 3/2008 Moore
2008/0227612 A1 9/2008 Harston
2008/0308614 A1 12/2008 Fitzwater
2009/0005228 A1 1/2009 Goto
2009/0039077 A1 2/2009 Fitzwater
2009/0139187 A1 6/2009 Wood
2009/0193757 A1 8/2009 Roesler
2009/0197750 A1 8/2009 Beckmann
2009/0214142 A1 8/2009 Bossel et al.
2009/0252440 A1 * 10/2009 Biese ..... B31B 70/00
383/37
2010/0022375 A1 1/2010 Colla
2010/0046861 A1 2/2010 Wilcoxen
2010/0066007 A1 * 3/2010 Muller ..... B65H 5/24
271/90
2010/0263332 A1 10/2010 Files et al.
2010/0284634 A1 11/2010 Hadley
2011/0017812 A1 1/2011 Belko et al.
2011/0019942 A1 1/2011 Piraneo
2011/0052106 A1 3/2011 Holmes et al.
2011/0053746 A1 3/2011 Desertot et al.
2011/0255809 A1 10/2011 Tucker et al.
2011/0297680 A1 12/2011 Howell et al.
2012/0224794 A1 9/2012 Veder
2012/0231941 A1 * 9/2012 Senbo ..... B31B 50/00
493/189
2012/0267425 A1 * 10/2012 Whiteside ..... B65D 5/5028
229/100
2012/0297736 A1 * 11/2012 Ausnit ..... B65B 5/024
53/456
2013/0068653 A1 3/2013 Lipinski
2013/0202229 A1 * 8/2013 Broering ..... B65D 33/28
383/75
2014/0016882 A1 1/2014 Fitzwater
2014/0045666 A1 2/2014 Endou et al.
2014/0113787 A1 4/2014 Aganovic et al.
2014/0128235 A1 * 5/2014 Walsh, Jr. ..... B65D 33/007
493/195
2014/0270592 A1 9/2014 Walsh
2015/0048152 A1 2/2015 Vistrom
2015/0072848 A1 3/2015 Graham et al.
2015/0083789 A1 3/2015 Fitzwater et al.
2015/0367974 A1 12/2015 Sytema
2016/0107814 A1 4/2016 Fitzwater
2016/0185065 A1 6/2016 Sytema
2016/0318274 A1 * 11/2016 Walsh ..... B65D 33/02
2016/0318275 A1 * 11/2016 Walsh ..... B65D 65/14
2016/0368205 A1 12/2016 Wieduwilt et al.
2017/0015079 A1 * 1/2017 Walsh ..... B31D 5/0004
2018/0086018 A1 3/2018 Fukuda
2018/0339480 A1 11/2018 Yanagisawa
2019/0143625 A1 5/2019 Lau

FOREIGN PATENT DOCUMENTS

CN 101102887 A 1/2008
CN 103434294 A 12/2013
DE 1 060 313 6/1959
DE 11 47 379 B 4/1963
DE 18 10 965 A1 10/1970
DE 203 00 817 4/2003
EP 0 729 828 A2 9/1996
EP 1 072 526 1/2001
EP 1 424 290 A2 6/2004
EP 1 452 458 9/2004
EP 1 457 425 9/2004
EP 1 353 843 B1 4/2005
EP 1 798 159 A1 6/2007
EP 1 964 785 9/2008
EP 2 487 027 8/2012
EP 2 492 203 8/2012
EP 2 492 204 8/2012
EP 2 748 078 B1 10/2016
EP 2 505 347 B1 12/2016
FR 1 048 714 A 12/1953
FR 2 516 481 5/1983

(56) References Cited

FOREIGN PATENT DOCUMENTS

| | | | | |
|---|---|---|---|---|
| FR | 2 665 882 | | 2/1992 | |
| FR | 2 687 384 | | 8/1993 | |
| GB | 632554 | | 11/1949 | |
| GB | 2 351 035 | A | 12/2000 | |
| GB | 2351035 | A * | 12/2000 | ..... B65D 33/2508 |
| GB | 2 365 000 | | 2/2002 | |
| JP | S61-232175 | | 10/1986 | |
| JP | 62-16319 | | 1/1987 | |
| JP | S63-502418 | | 9/1988 | |
| JP | 5-28626 | | 4/1993 | |
| JP | 5-147664 | | 6/1993 | |
| JP | 2004 224402 | | 8/2004 | |
| JP | 2005-320022 | A | 11/2005 | |
| JP | 2006-240671 | A | 9/2006 | |
| JP | 2008-105707 | A | 5/2008 | |
| JP | 2011-168330 | | 9/2011 | |
| JP | 2011-168331 | | 9/2011 | |
| JP | 2011-173640 | | 9/2011 | |
| JP | 2011-189978 | A | 9/2011 | |
| JP | 2010-222050 | | 10/2011 | |
| JP | 2011-251774 | A | 12/2011 | |
| JP | 2012-51579 | | 3/2012 | |
| JP | 2012-152901 | | 8/2012 | |
| JP | 2012-187899 | | 10/2012 | |
| JP | 2012-533487 | | 12/2012 | |
| JP | 2018-039167 | A | 3/2018 | |
| NL | 87 840 | C | 11/1957 | |
| WO | WO 87/03249 | | 6/1987 | |
| WO | WO 2006/052326 | | 5/2006 | |
| WO | WO 2007/067705 | | 6/2007 | |
| WO | WO 2007/084525 | A2 | 7/2007 | |
| WO | WO 2008/086277 | | 7/2008 | |
| WO | WO 2009/023286 | | 2/2009 | |
| WO | WO 2011/011283 | A2 | 1/2011 | |
| WO | WO 2011/031545 | A2 | 3/2011 | |
| WO | WO 2011/040994 | A1 | 4/2011 | |
| WO | WO 2013/003149 | A | 1/2013 | |
| WO | WO 2013/117983 | A2 | 8/2013 | |
| WO | WO 2014/070232 | A1 | 5/2014 | |
| WO | WO 2015/028825 | A1 | 3/2015 | |
| WO | WO 2016/176540 | A1 | 11/2016 | |

OTHER PUBLICATIONS

Supplementary European Search Report for EP 16 78 7209 dated Dec. 17, 2018.

Supplementary European Search Report for EP 14 84 9557 dated Jun. 7, 2017.

Supplementary European Search Report for EP 16 78 7218 dated Jan. 28, 2019.

Notification of the First Office Action for Chinese Application No. 201680041116.7 dated Jan. 4, 2019, with English translation.

Office Action for Canadian Application No. 2,980,354 dated Oct. 1, 2018.

International Search Report and Written Opinion for PCT/US2016/042010 dated Oct. 12, 2016.

International Search Report and Written Opinion for PCT/US2016/029989 dated Aug. 16, 2016.

International Search Report and Written Opinion for PCT/US2016/030046 dated Aug. 19, 2016.

International Search Report and Written Opinion for PCT/US2016/047521 dated Dec. 13, 2016.

Supplementary Partial European Search Report for EP 14 84 9557 dated Mar. 7, 2017.

International Search Report and Written Opinion for PCT/US2016/043520 dated Oct. 28, 2016.

International Search Report and Written Opinion for PCT/US2014/057385 dated Jan. 30, 2015.

Supplementary European Search Report for EP 16 82 5077 dated Mar. 4, 2019.

International Search Report and Written Opinion for PCT/US2019/040772 dated Oct. 24, 2019.

Notice of Reasons for Refusal for Japanese Application No. 2018-501343 dated Oct. 28, 2019, with English translation.

* cited by examiner

METHOD AND SYSTEM FOR FORMING PACKAGES

CROSS-REFERENCE TO RELATED APPLICATIONS

This application claims the benefit of U.S. Provisional Patent Application No. 62/231,723, filed on Jul. 14, 2015.

INCORPORATION BY REFERENCE

The disclosures of U.S. Provisional Patent Application No. 62/231,723, filed Jul. 14, 2015, U.S. Provisional Patent Application No. 62/179,172, filed Apr. 29, 2014, and U.S. Provisional Patent Application No. 62/179,480, filed May 8, 2015, U.S. patent application Ser. No. 14/496,252, filed Sep. 25, 2014, U.S. patent application Ser. No. 15/142,103, filed Apr. 29, 2016, U.S. patent application Ser. No. 15/142,435, filed Apr. 29, 2016, are hereby incorporated by reference as if presented herein in their entirety and are incorporated by reference for all purposes.

BACKGROUND OF THE DISCLOSURE

The present disclosure generally relates to reinforced packages for holding products and to methods of forming the packages. More specifically, the present disclosure is directed to methods and systems for forming the packages including a bag or liner having a sealed bottom portion and sealed side portions, the bag or liner being attached to a carton or blank.

Bags or liners, such as paper or plastic bags, traditionally have been used for the packaging and transport of products from bulk materials such as rice or sand to larger items. Bags or liners generally are inexpensive and easy to manufacture and can be formed in different configurations and sizes, and can be used for storage and transport of a wide variety of products. In particular, in the food service industry, bags or liners are frequently used for packaging of prepared food items, such as sandwiches, French fries, cereal, etc. Currently, there is a growing demand for bags or liners or similar packages for use in packaging various products, including sandwiches, French fries, cereal, and other prepared food items, for presentation to consumers. However, it is equally important that the costs of such packages necessarily must be minimized as much as possible. While various packages designs including reinforcing or supporting materials have been developed, often, the manufacture of such specialty bags or liners having reinforcing layers or materials supplied thereto has required multiple stages or operations, which can significantly increase the cost of manufacture of such packages.

SUMMARY OF THE DISCLOSURE

In general, one aspect of the disclosure is directed to a method of at least partially forming reinforced packages. The method comprises moving a web of material in a downstream direction through a web forming section, at least partially forming at least a bag portion in the web of material during the moving the web of material through the web forming section, forming an attached web by adhering a construct to the bag portion of the web of material, and moving the attached web through a separating station. The moving the attached web can comprise moving the construct with the web of material. The method further can comprise separating the bag portion from a remainder of the web of material to form a bag during the moving the attached web through the separating station, the bag being attached to the construct.

In another aspect, the disclosure is generally directed to a system for at least partially forming reinforced packages. The system can comprise a web forming section receiving a web of material for at least partially forming at least a bag portion in the web of material. An attachment assembly can be for adhering a construct to the bag portion of the web of material to form an attached web. A separating station can be for receiving the attached web and separating the bag portion from a remainder of the web of material to form a bag attached to the construct.

Additional aspects, features, and advantages of the present invention will become apparent from the following description and accompanying figures.

BRIEF DESCRIPTION OF THE DRAWINGS

Those skilled in the art will appreciate the above stated advantages and other advantages and benefits of various additional embodiments by reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to a system and method of forming reinforced packages for holding products such as food products or other articles. Packages according to the present disclosure can accommodate articles of any shape. The packages can comprises a bag, liner, or wrap material comprising a relatively flexible material attached to a reinforcing construct comprising a relatively rigid material (e.g., paperboard). The bags or liners can generally be made from a paper, plastic or other stock material and can be attached to the reinforcing construct. In one embodiment, the liners comprise polyethylene material or any other suitable heat-sealable material. The reinforcing construct can be of varying widths and can extend about or over the closed ends of the bags, in some embodiments enclosing such closed ends, and will provide support for the bags upon loading with a product or article or series of articles therein. In some embodiments, the reinforcing construct can be folded with their bags into a configuration supporting the bags in a freestanding, upright and opened condition for ease of loading and ease of use.

Figure 1:
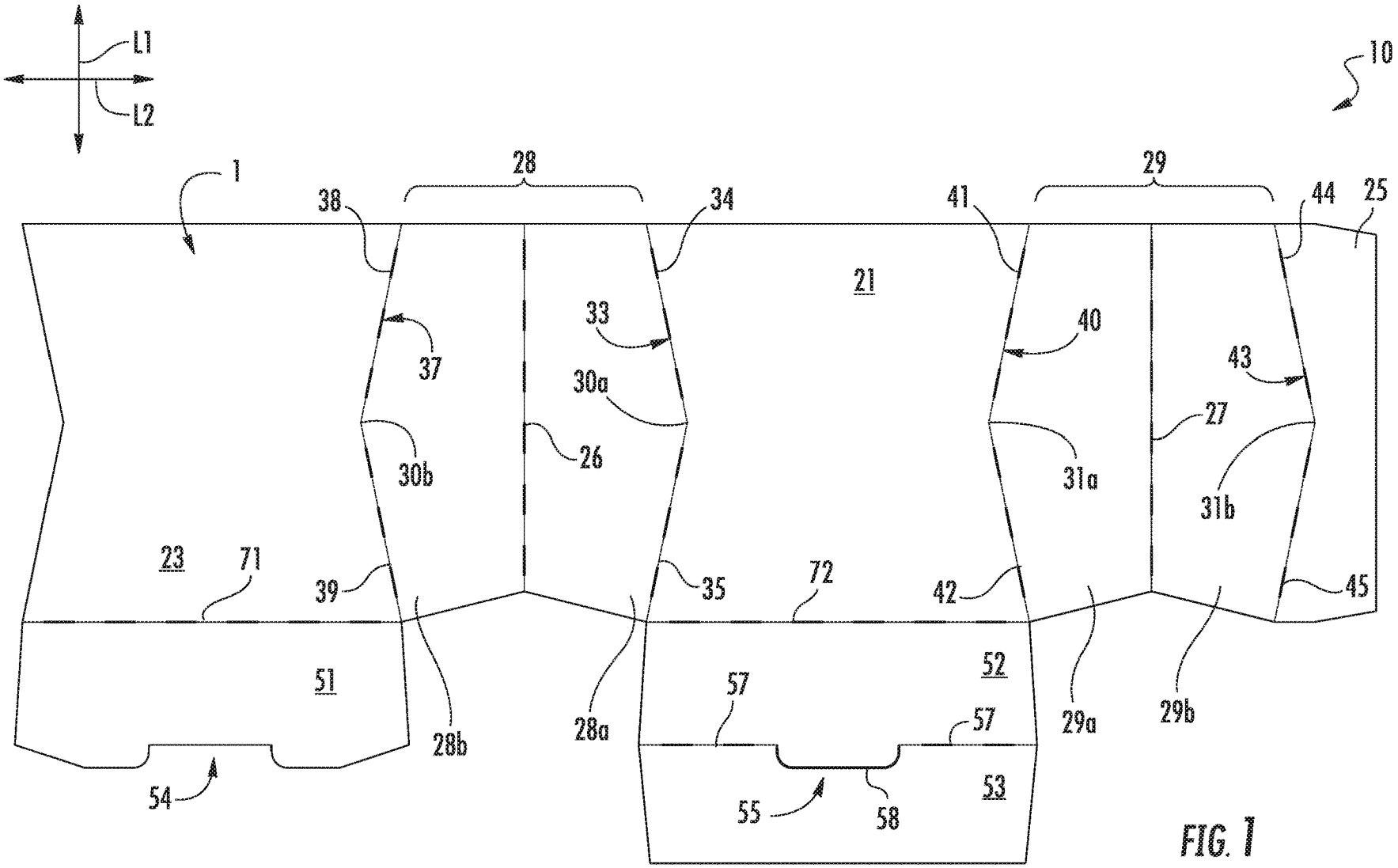
FIG. 1 is an exterior plan view of a blank used to form a carton of a package according to an exemplary embodiment of the disclosure.
Figure 4:
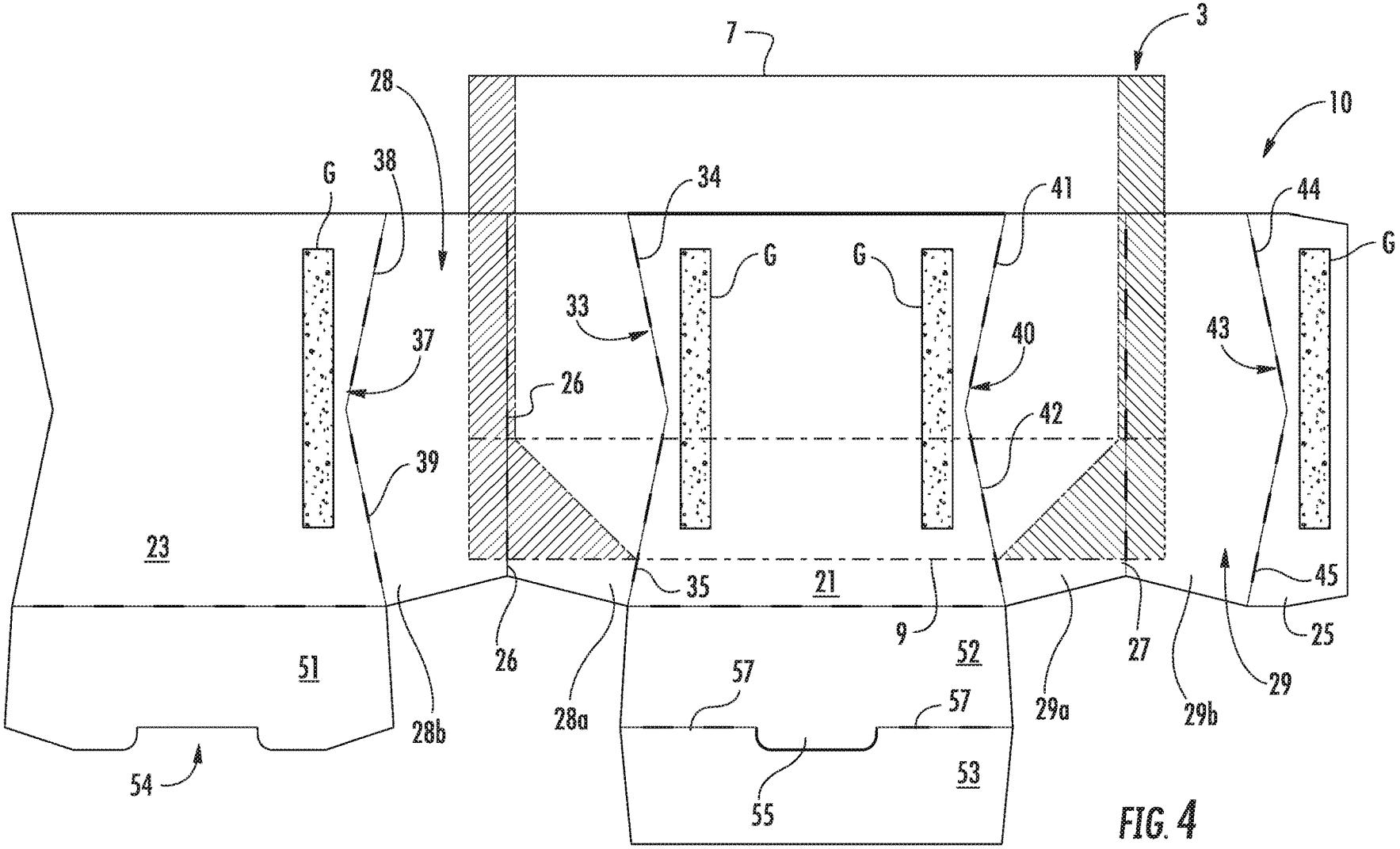
FIG. 4 is an exterior plan view showing the bag formed from a bag portion of FIG. 3 attached to the blank of FIG. 1 according to the exemplary embodiment of the disclosure.
Figure 5:
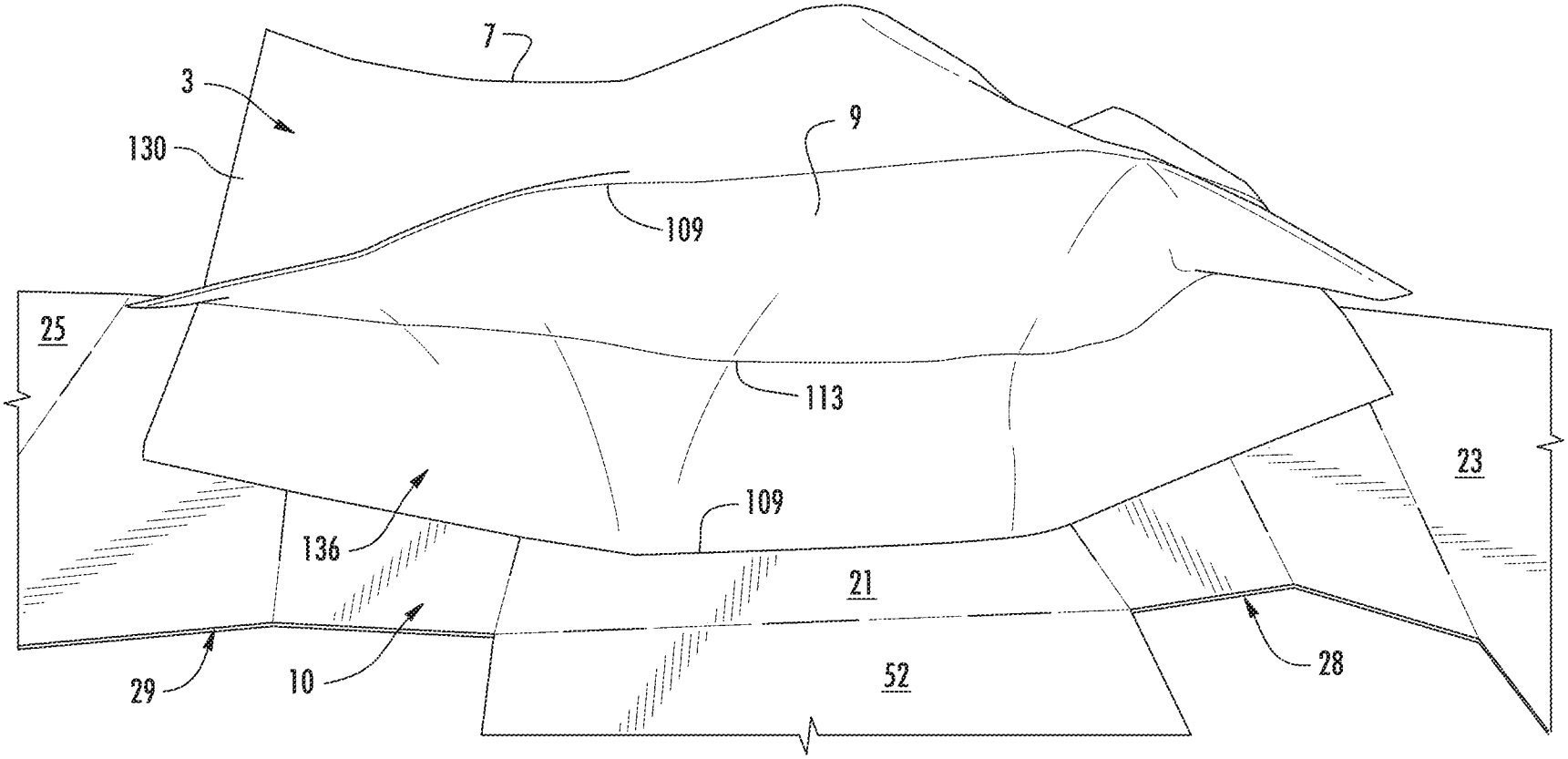
FIG. 5 is a bottom view of the bag on the blank of FIG. 4.

FIG. 1 is a plan view of an interior surface 1 of a carton blank 10 for forming a reinforcing carton 5 (FIGS. 6-9) for holding a bag 3 or liner in a reinforced package 152 (FIGS. 6-9) according to an embodiment of the disclosure. In one embodiment, the reinforced package is similar or identical to the reinforced package of U.S. patent application Ser. No. 14/496,252, filed Sep. 25, 2014, the entire disclosure of which is incorporated by reference herein for all purposes. One embodiment of the system and method of the present disclosure can form a series of attached bag portions 3' (FIG. 3) from a web 101 (FIG. 2), attach individual bag portions 3' from the series of bag portions to respective blanks 10, and separate the attached bag portions 3' from the web to form the bags 3 attached to respective blanks 10 (FIGS. 4 and 5). The bag 3 has an open top end 7, a closed or sealed bottom end 9, and an interior space 150 for holding a product. In one embodiment, the bag 3 has sealed sides 130 extending the length of the bag. The reinforcing carton 5 has a bottom 20 that supports the sealed bottom 9 of the bag 3. Alternatively, the carton 5 could have an open bottom and/or could be positioned to extend around a middle portion or top portion of the bag 3 without departing from the disclosure.

As shown in FIG. 1, the carton blank 10 has a lateral axis L1 and a longitudinal axis L2. In the illustrated embodiment, the carton blank 10 has a front panel 21 foldably connected to a first side panel 28 at a first fold line 33, a back panel 23 foldably connected to the first side panel 28 at a second fold line 37, and a second side panel 29 foldably connected to the front panel 21 at a third fold line 40. As shown in FIG. 1, a second back panel or attachment flap 25 is foldably connected to the second side panel 29 at a fourth fold line 43. As shown in FIG. 1, the first side panel 28 includes two individual panel portions 28*a*, 28*b* foldably connected to one another along a lateral fold line 26. Similarly, the second side panel 29 includes two individual panel portions 29*a*, 29*b* foldably connected to one another along a lateral fold line 27.

In the illustrated embodiment, the first fold line 33 is segmented into two oblique fold line segments 34, 35 extending from a vertex 30*a*. The second fold line 37 is segmented into two oblique fold line segments 38, 39 extending from a vertex 30*b*. The third fold line 40 is segmented into two oblique fold line segments 41, 42 extending from a vertex 31*a*. The fourth fold line 43 is segmented into two oblique fold line segments 44, 45 extending from a vertex 31*b*. The fold lines 33, 37 can be spaced apart from lateral fold line 26 so that the vertices 30*a*, 30*b* are spaced apart from the lateral fold line 26 farther than the opposite ends of the oblique fold line segments 34, 35, 38, 39 (e.g., the panel portions 28*a*, 28*b* and the first side panel 28 are widest between or adjacent the vertices 30*a*, 30*b*). Similarly, the fold lines 40, 43 are spaced apart from lateral fold line 27 so that the vertices 31*a*, 31*b* are spaced apart from the lateral fold line 27 farther than the opposite ends of the oblique fold line segments 41, 42, 44, 45 (e.g., the panel portions 29*a*, 29*b* and the first side panel 29 are widest between or adjacent the vertices 31*a*, 31*b*). The fold lines 33, 37, 40, 43 could be omitted or could be otherwise arranged, shaped, positioned, and/or configured without departing from the disclosure. For example, the fold lines could be arcuate fold lines rather than segmented fold lines as shown.

As shown in FIG. 1, the blank 3 further can include a first bottom panel 51 foldably connected to the back panel 23 at longitudinal fold line 71 and a second bottom panel 52 foldably connected to the front panel 21 at longitudinal fold line 72. As illustrated, a bottom end flap 53 is foldably connected to the second bottom panel 52 at fold lines 57. A locking tab 55 extends from the second bottom panel 52 and is separable from the bottom end flap 53 along a cut 58. Furthermore, a complementary locking notch or recess 54 is formed in the first bottom panel 51 and defines an edge of the first bottom panel 51 for engaging the locking tab 55. The locking notch 54 is sized or dimensioned to engage the locking tab 55. The tab 55 engages the notch 54 to assist in the locking the first and second bottom panels 51, 52 to form the bottom 20 of the carton 5. Any of the bottom panels 51, 52, the bottom end flap 53, and/or the locking features 54, 55 could be omitted or could be otherwise arranged, shaped, positioned, and/or configured without departing from the disclosure.

In the illustrated embodiment, the carton blank 3 and carton 5 can comprise any material which is relatively rigid such as paperboard, clay-coated paperboard, solid bleached board (SBB) paperboard, solid bleached sulfate (SBS) paperboard, kraft lined paperboard, or any other suitable material without departing from the disclosure. In alternative embodiments, the carton blank 3 could be otherwise shaped and could have alternative panel, flap, fold line, and/or panel portion arrangements.

In alternative embodiments, the blank 10 can have alternative panel, fold line, and/or panel portion arrangements. U.S. patent application Ser. No. 14/826,937, filed Mar. 14, 2013, is incorporated by reference herein for all purposes, and illustrates various reinforced packages including various reinforcing constructs, blanks, and bags that can be formed from the method and system of the present disclosure.

Figure 6:
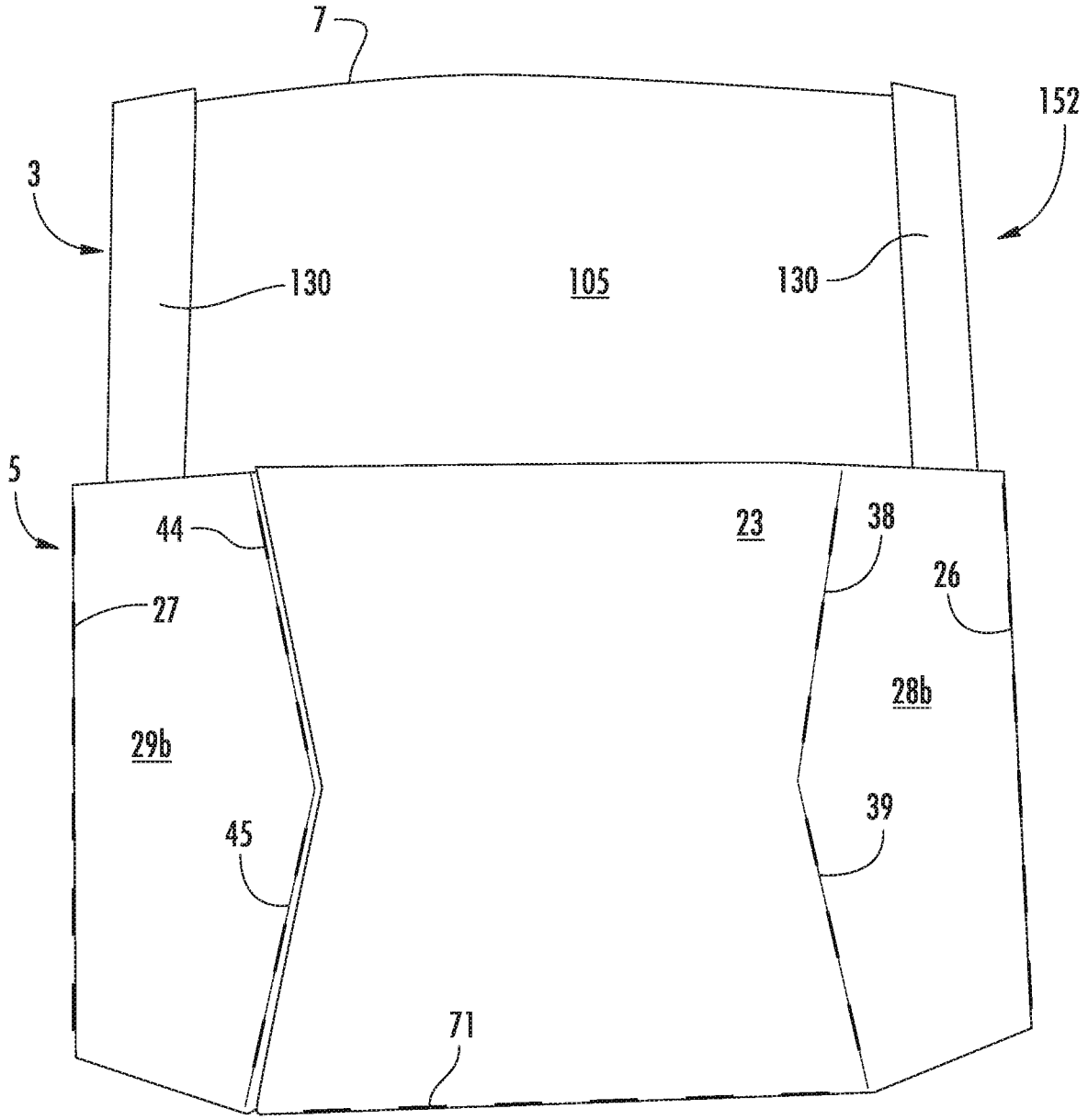
FIGS. 6-10 are various views of the package including the bag of FIG. 4 and the carton formed from the blank of FIG. 4 in a flat configuration and in an erected configuration.
Figure 7:
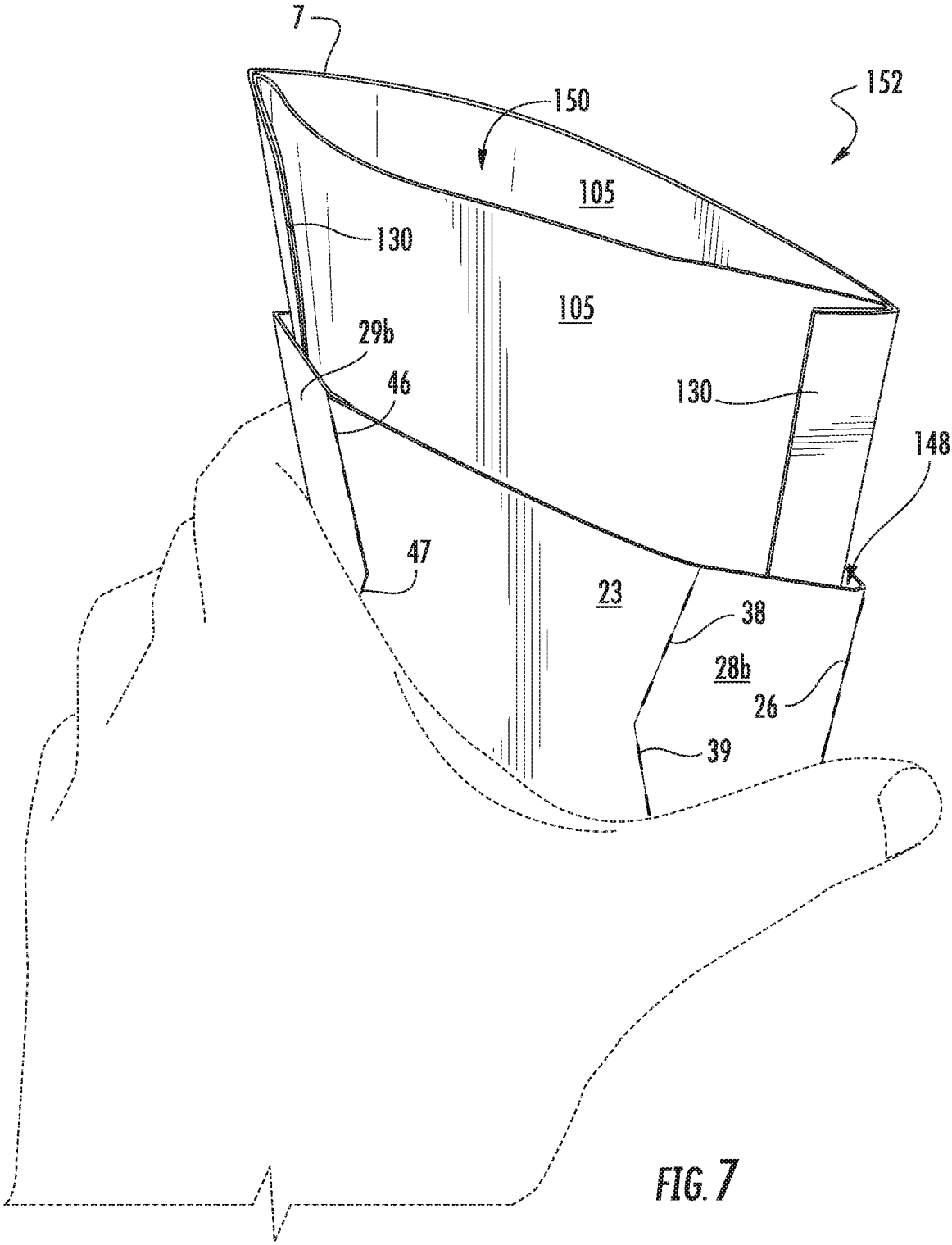

Generally, the back panel 23 and the attachment flap 25 can be overlapped and glued and the blank 10 may be folded about fold lines 26, 27, 33, 37, 40, 43 to position the front panel 21, side panels 28, 29, and overlapped back panel 23 and attachment flap 25 to form the carton 5 (FIG. 6). The bottom panels 51, 52 and the bottom end flap 53 can be overlapped and secured by adhesive and/or by the locking features 54, 55 to from the closed bottom 20 of the carton 5. In the illustrated embodiment, the carton 5 can be positioned in a collapsed configuration (FIG. 6), wherein the front and back panels 21, 23 are brought closer together, folding the side panels 28, 29 along fold lines 26, 27, and an opened configuration wherein the front and back panels 21, 23 are spaced apart and the side panels 28, 29 are folded along the fold lines 33, 37, 40, 43 and pushed inwardly. The bottom 20 can fold inwardly when the carton 5 is in the collapsed configuration in the illustrated embodiment. The reinforced carton 5 may be otherwise shaped, arranged, and configured without departing from the disclosure. For example, the bottom 20 could be configured to fold outwardly when the carton is in the collapsed configuration.

Figure 2:
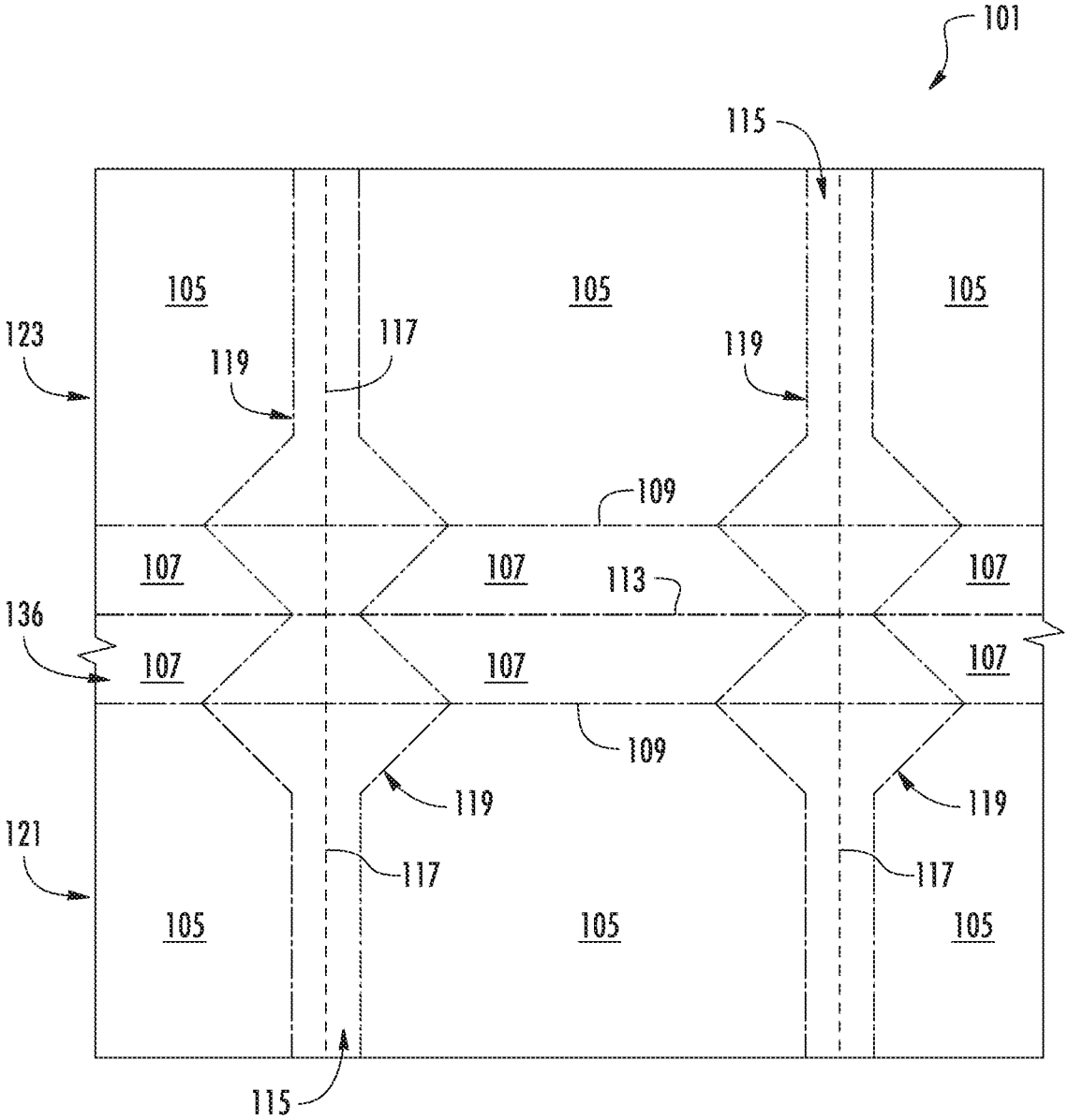
FIG. 2 is a plan view of a portion of a web for forming a bag of the package 152 according to the exemplary embodiment of the disclosure.

FIG. 2 shows a web 101 for forming the bags 3 that are attached to the respective blanks 10. The web 101 in FIG. 2 includes a number of lines schematically showing the relative location of different features formed in the web by the system and method of the present disclosure. These lines may or may not be formed in the web prior to forming the bags (e.g., before the web is folded, heat sealed, and/or cut). For example, the fold lines can be formed as the web is folded, the boarders of the heat sealed areas can be formed by the shape of the heating elements as the web is heat sealed, and/or the perforation lines can be formed by a perforator. Alternatively, some or all of the lines could be printed or otherwise formed in the web prior to forming the bags.

The web 101 may be formed of generally non-permeable material or layers of material, such that a formed bag 3 may hold liquid. The web 101 can comprise any suitable material which is relatively flexible and relatively fluid impervious. The liner blank 103 can comprise paper material laminated with plastics such as polyethylene, polypropylene, polyethylene terephthalate, polystyrene, poly vinyl chloride, or any other suitable material without departing from the disclosure. Alternatively, the web 101 could comprise a fluid pervious material without departing from the disclosure.

As shown in FIG. 2, the web 101 may include two sidewalls 105 foldably connected to gusset panels 107 at fold lines 109, respectively, for each portion that forms a respective bag 3. The gusset panels 107 may be foldably connected to one another at fold line 113. The web 101 may include seal areas 115 extending along respective marginal areas of each portion that forms a respective bag 3 and at least partially defined between lines 119. Any of the sidewalls 105, the gusset panels 107, and/or the seal areas could be omitted or could be otherwise arranged, shaped, positioned, or configured without departing from the disclosure.

Figure 3:
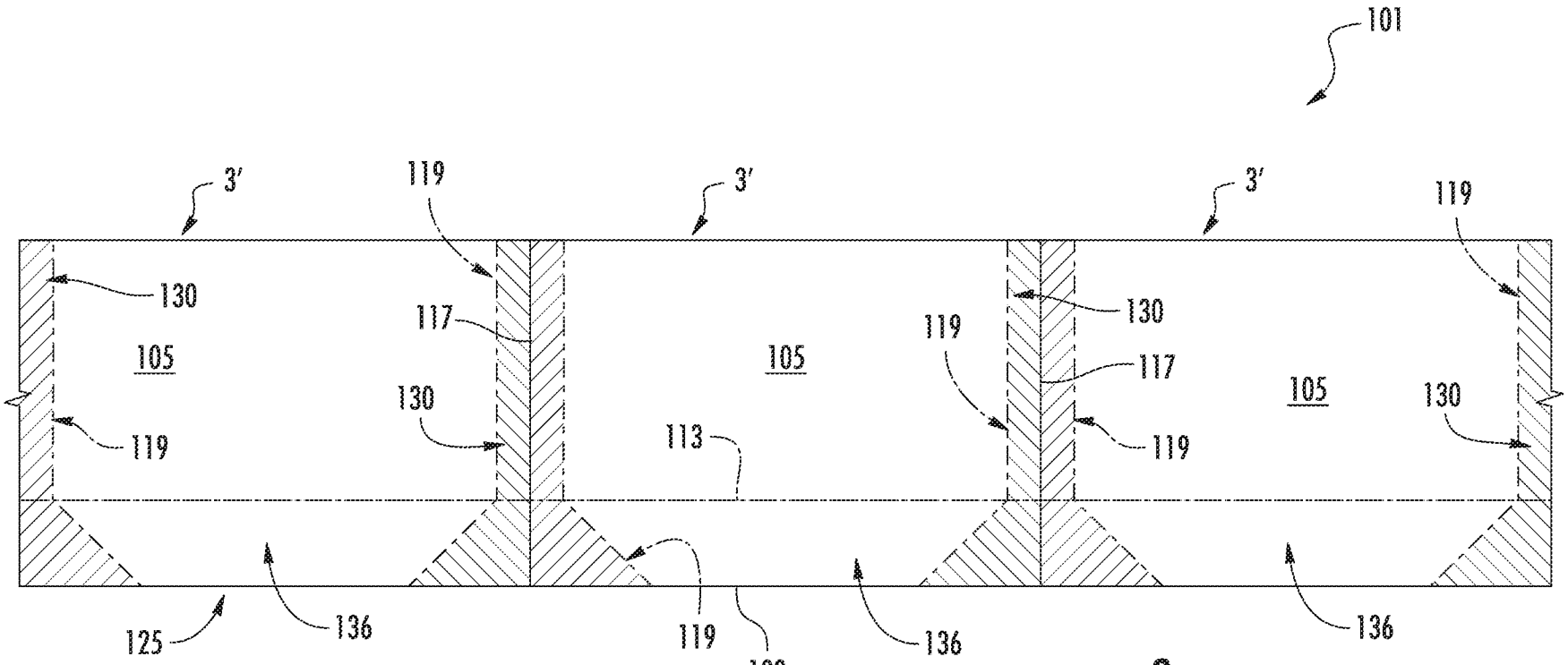
FIG. 3 is an exterior plan view of the web of FIG. 2 after folding the web and forming bag portions according to the exemplary embodiment of the disclosure.

In one embodiment, and as described further below, the system and method of the present disclosure can include a web forming section that generally can fold the web 101, form heat sealed areas in the web, and form perforation lines in the web to form the attached bag portions 3' (FIG. 3). In the illustrated embodiment, the web forming section folds a first portion 121 of the web 101 over a second portion 123 of the web while pushing the gusset panels 107 inwardly to form a gusset 136 (FIGS. 3-5 and 10). The folding of the web 101 can form the fold lines 109, 113 where the web 101 is folded. The web forming section further can form heat sealed areas 130 at the seal areas 115 in the web 101 so that portions of the web 101 are sealed at the bottom by the gusset 136 and at the sides by heat sealed areas 130. As shown in FIG. 3, the heat sealed areas 130 extend along the marginal portions of each bag portion 3'. Accordingly, the heat sealed areas 130 each extend along the marginal side portions of two adjacent bag portions 3'. In addition, the web forming section can form lines of weakening 117 (e.g., tear lines or perforation lines) in the web 101, generally bifurcating the heat sealed areas 130 so that the sealed portions of the web 101 are separable from one another along the perforation lines 117. Accordingly, the web 101 is folded, sealed, and perforated to form a series 125 of bag portions 3' as shown in FIG. 3.

The bag portions 3' can be glued to the front panels 21 of respective blanks 10 with glue strips G, for example (FIG. 4). In one embodiment, additional glue strips G applied to the blank 10 for attaching the attachment flap 25 to the back panel 23 and/or for attaching the back panel 23 and/or the attachment flap 25 to the bag. In the illustrated embodiment, after the bag portions 3' are adhered to the respective blanks 10, the bags 3 can be separated from the series 125 of attached bag portions 3' along the perforation lines 117 (FIG. 4). The bag 3 could be formed from the web 101 by alternative steps without departing from the disclosure.

Figure 8:
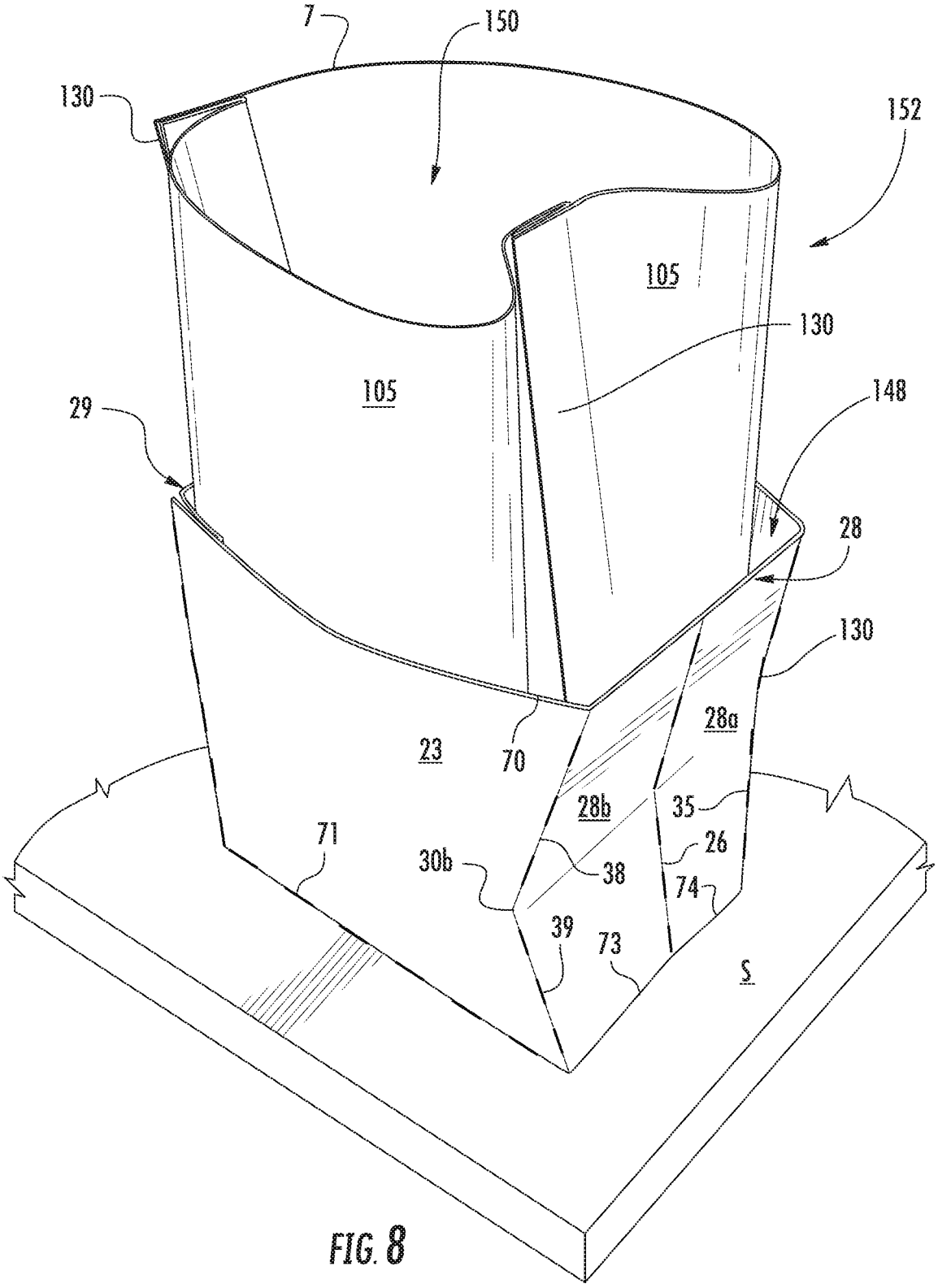
Figure 9:
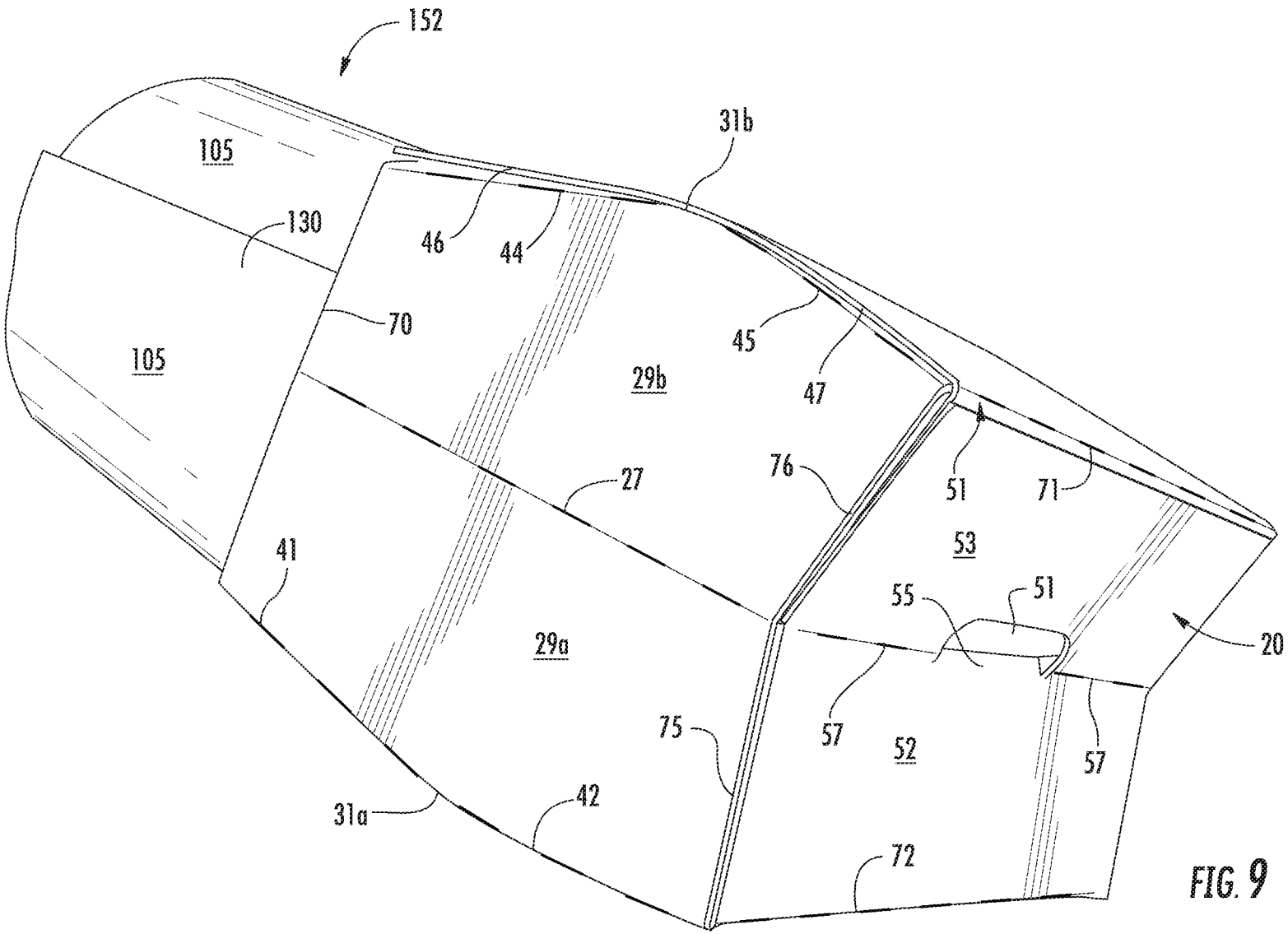
Figure 10:
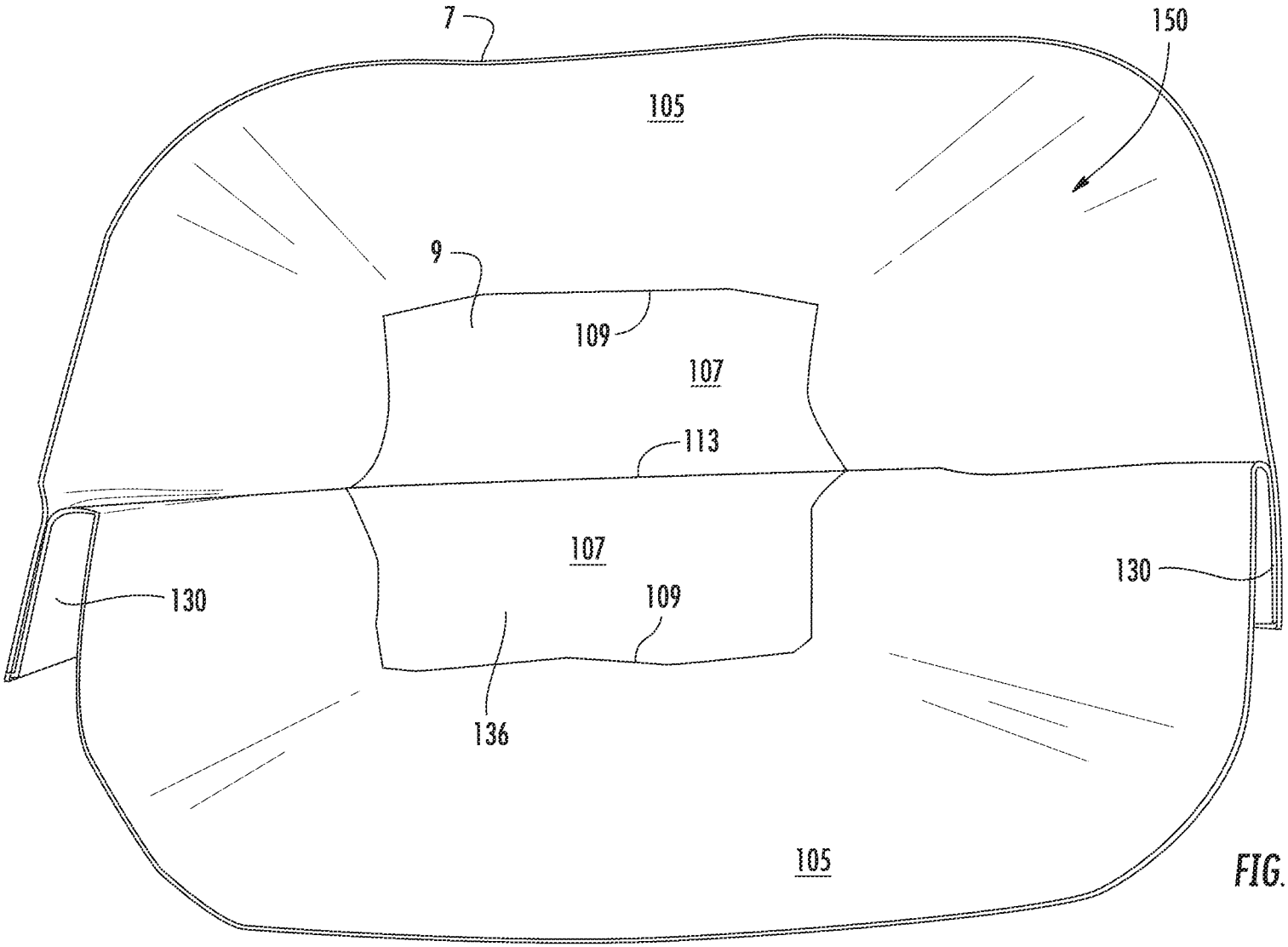

The package 152 can be formed by forming the carton 5 around the bag 3 from the combination of the bag 3 and the blank 10 shown in FIG. 4 such as by a folder/gluer system. The package 152 can be in the collapsed configuration (FIG. 6) and the side panels 28, 29 can be squeezed inwardly (FIG. 7) to erect the package 152 into the opened configuration (FIGS. 8-10). The first, non-erect position illustrated reduces and/or minimizes (e.g., collapses) a volume of an interior space 150 of the bag 3 such that the reinforced package is in a non-erect or semi-flattened state. The non-erect state may facilitate easy stacking of a plurality of packages into, for example, a shipment container and subsequent organization at a destination facility. When the package 152 is moved to the erected or opened configuration, the side panels 28, 29 are pushed inwardly at the respective fold lines 26, 33, 37 and 27, 40, 43. Accordingly, the front panel 21 and the back panel 23 move away from one another and the bottom panels 51, 52 can fold along fold lines 57, 71, 72 to be generally coplanar, extending between the front panel and the back panel. Further, the sidewalls 105 of the bag 3 are glued to the respective front panel 21 and back panel 23 of the carton 5, and the bag can be positioned in the open position by the front and back panels as the side panels 28, 29 are moved inwardly. In one embodiment, as the panels 105 of the bag 3 move away from one another, the gusset panels 107 can fold along fold lines 109, 113 to extend across the bottom 9 of the opened bag 3 (e.g., as shown in FIGS. 5 and 10). In the illustrated embodiment, the bag 3 is sealed at its sides by the heat sealed areas 130 and at its bottom by the gusset panels 107 when the package 152 is in the collapsed configuration and in the opened configuration. The package could be otherwise shaped, arranged, and/or configured without departing from the disclosure.

FIGS. 11-17 illustrate various example embodiments and components of systems and methods 200 for forming the reinforced packages (e.g., reinforced packages 152) in accordance with the disclosure. In the illustrated embodiment, the packaging system 200 forms the web 101 into the series 125 of bag portions 3' at an upstream end 203 of the system 200 and attaches the bag portions 3' to respective constructs 10 (e.g., the blanks 10) to form an attached web 101' (the blanks 10 attached to the respective bag portions 3'). The blanks and web can move through the system 200 to a downstream end 205 generally in a machine direction M, and the combination of the bag 3 attached to the blank 10 is formed when the bag 3 is separated from the remainder of the attached web 101' at the downstream end 205. The blanks 10 with the attached bags 3 can be output from the system 200 directly to a folder/gluer system (not shown), could be transported to a separate folder/gluer system, and/or could be manually glued and folded to form the packages 152. In one embodiment, the system 200 of the present disclosure includes a web forming section or portion 260 that forms the web 101 into the series 125 of adjacent bag portions 3' that are formed into the respective bags 3 of each package 152. The system and method 200 of the present disclosure can have similar or identical features, methods, processes, and/or components as the system and methods disclosed in incorporated-by-reference U.S. Provisional patent application Ser. No. 15/142,103, filed Apr. 29, 2016 (the '103 Application), and U.S. patent application Ser. No. 15/142,435, filed Apr. 29, 2016 (the '435 Application).

Figure 11:
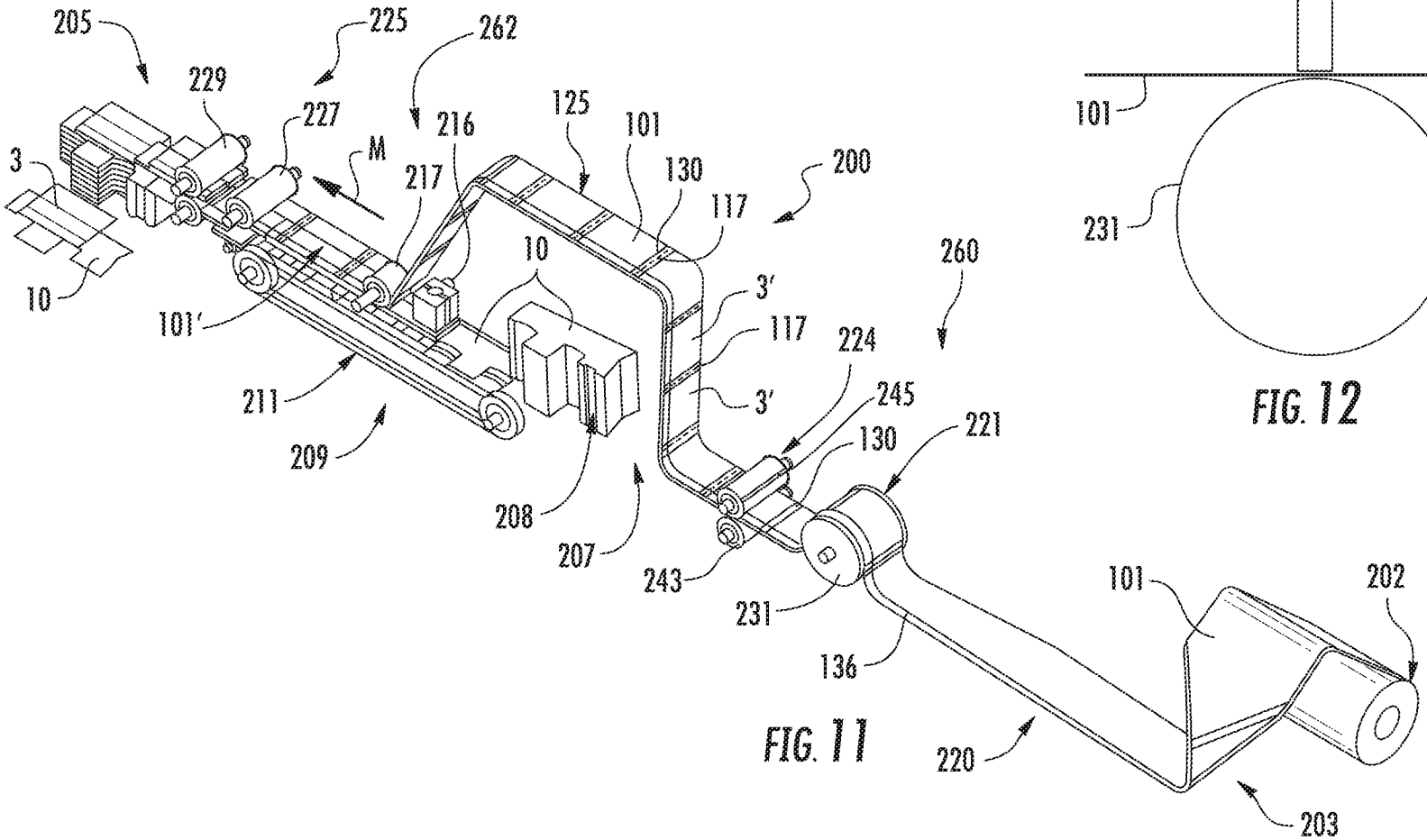
FIG. 11 is a schematic perspective view of a system and method for forming the bag portions of FIG. 3 in the web of FIG. 2, attaching the bag portions to the blanks of FIG. 1, and separating the bag portions to form the combination of a bag and blank of FIG. 4 according to the exemplary embodiment of the disclosure.
Figure 14:
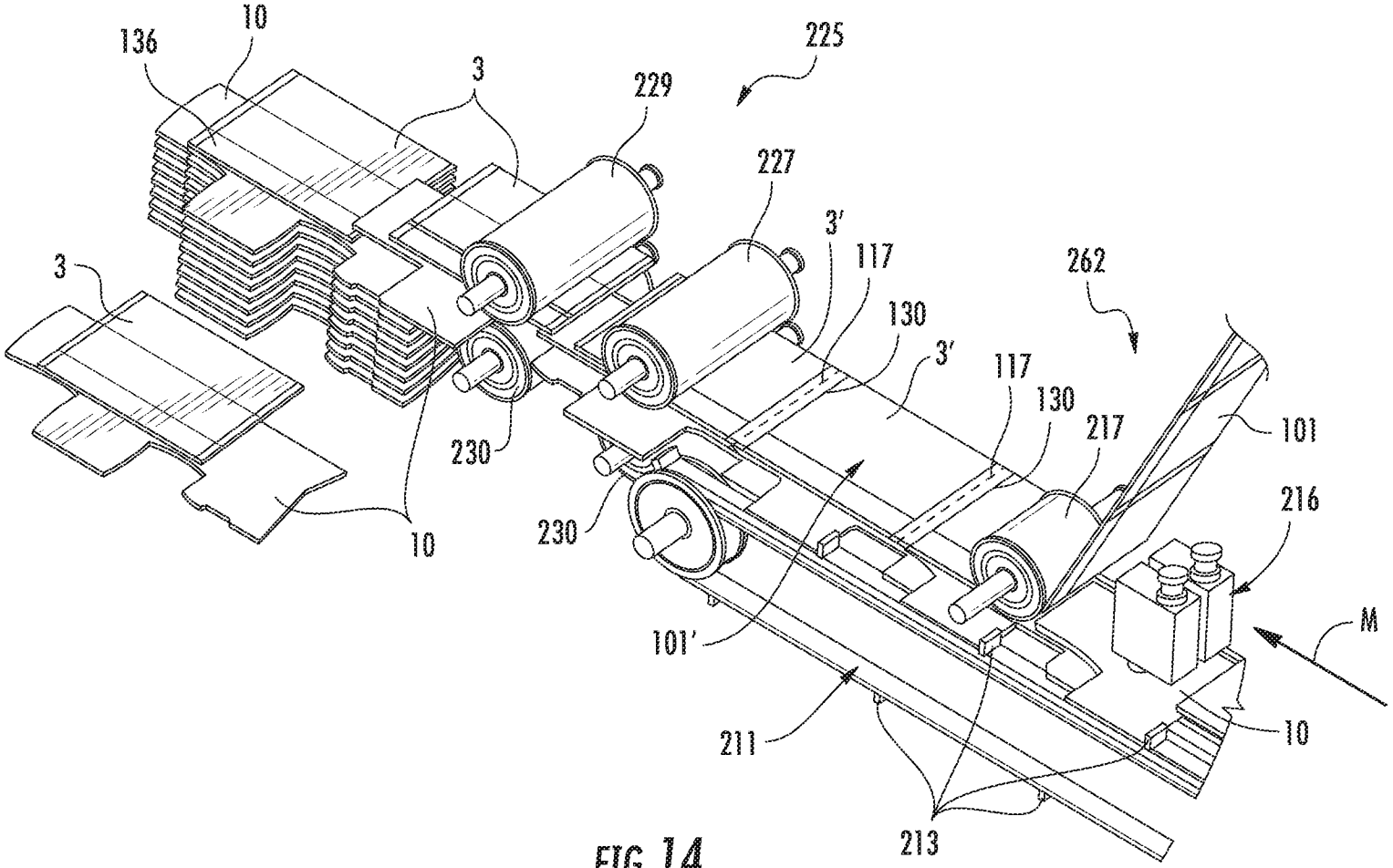
FIG. 14 is a schematic perspective view of a portion of the system for attaching the bag portions of FIG. 3 to the blanks of FIG. 1 and separating the bags according to the exemplary embodiment of the disclosure.
Figure 15:
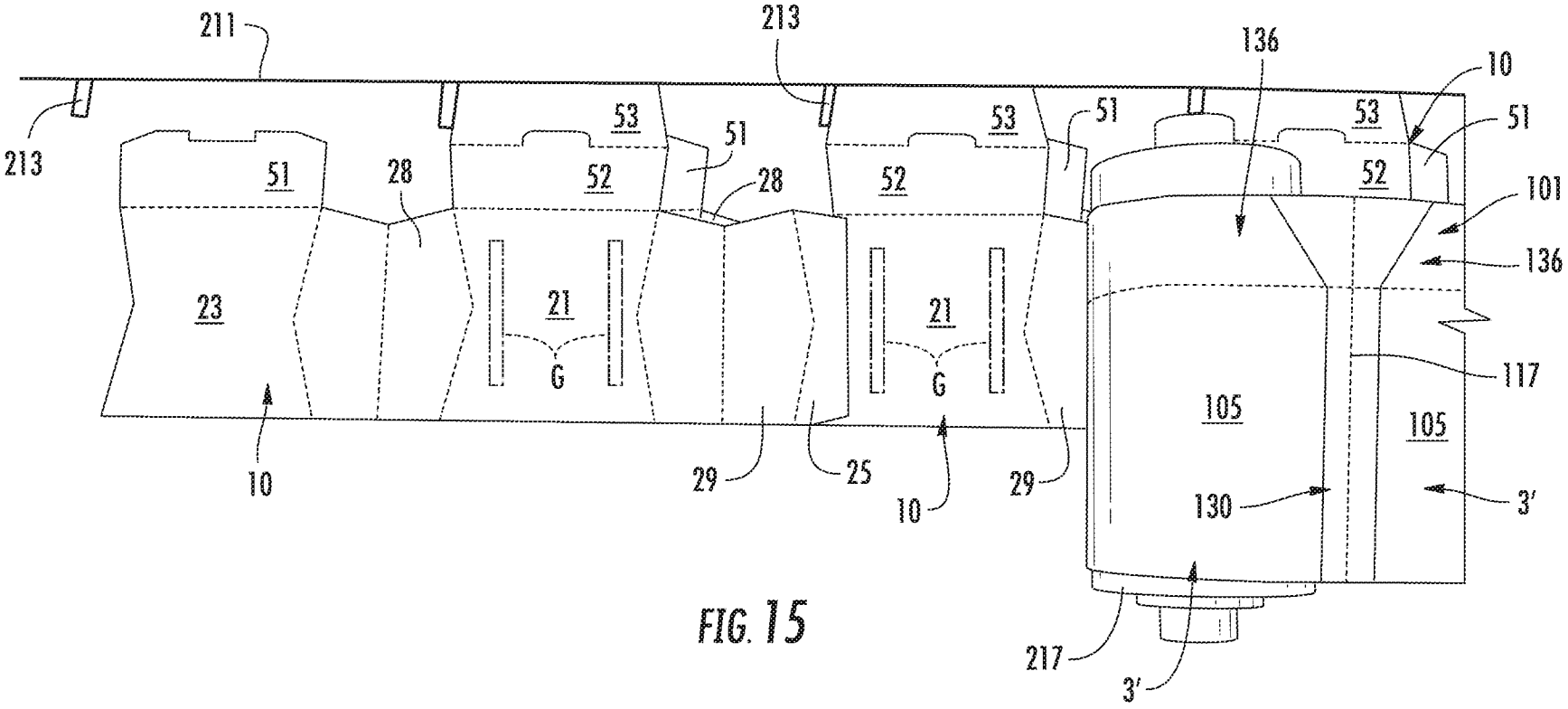
FIG. 15 is a schematic top view of the nip roller gluing the bag portions of FIG. 3 to the partially overlapped blanks of FIG. 1 according to the exemplary embodiment of the disclosure.
Figure 16:
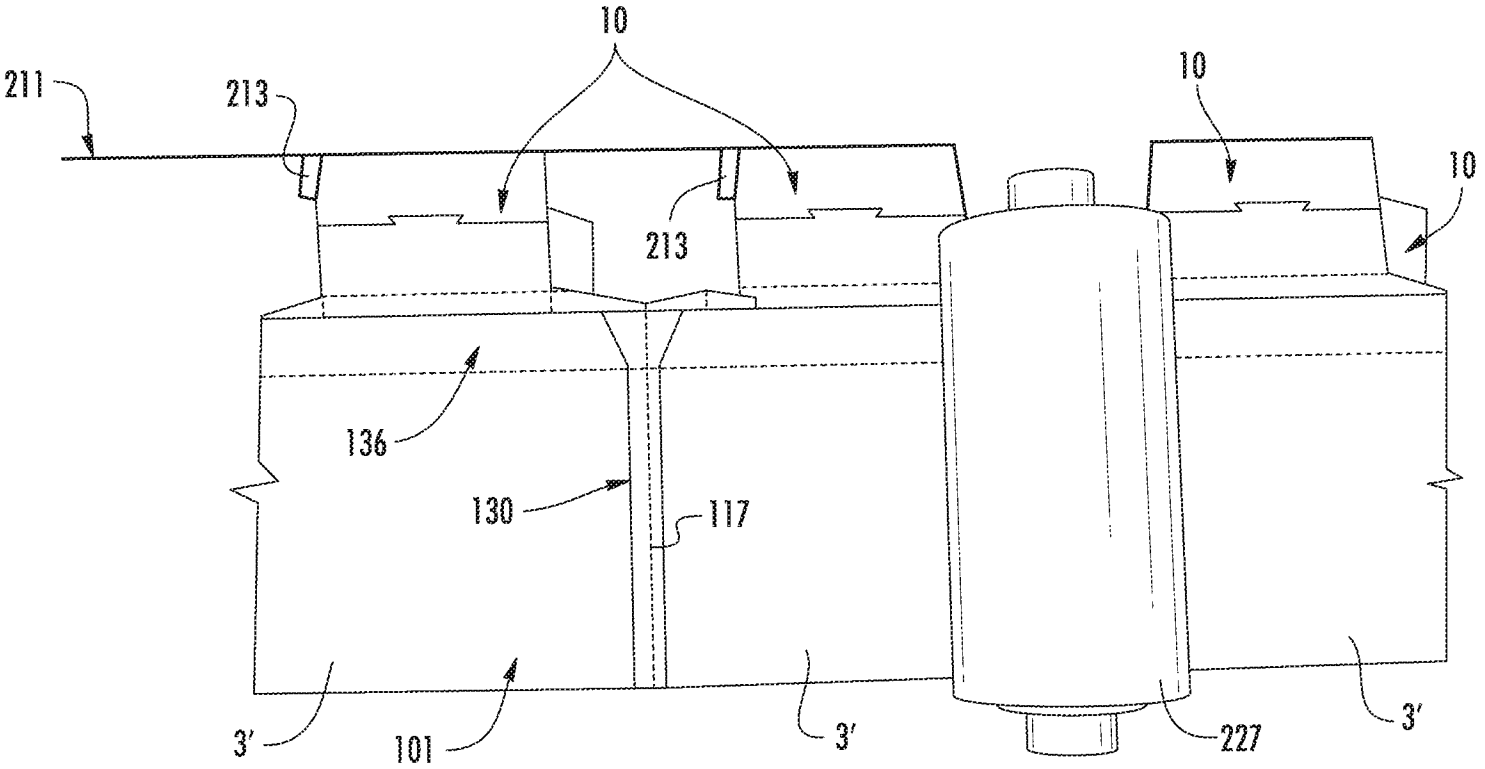
FIG. 16 is a schematic top view of the blanks glued to the bag portions engaging a slower upstream roller according to the exemplary embodiment of the disclosure.

As shown in FIG. 11, in one embodiment of the system and method 200 for manufacturing the combination of the bags 3 attached to the respective blanks 10 for forming reinforced packages 152, the web of bag material 101 can include preprinted paper, polyethylene or other material including flexible and heat-sealable materials. In the web forming portion 260 of the system 200, the web of material 101 is fed from a roll or supply 202. The bag material 101 can be pre-printed with various designs, lettering, labels or other graphics. Alternatively, the web 101 could be free from printed material and/or labels. In one alternative embodiment, the web 101 can be perforated, printed roll stock that can includes patterned adhesive that is positioned to facilitate forming the web 101 into the bags 3. The web forming portion 260 includes a gusset forming assembly 220 and the web 101 of material passes through the gusset forming assembly where the bottom 9 of the bags 3 are formed to include a bottom gusset 130 having folds 109, 113 (FIGS. 3, 5, and 10). The gusset 136 and the folded web can be formed by folding a first portion 121 of the web 101 over a second portion 123 (e.g., FIG. 2) while pushing the gusset panels 107 inwardly (e.g., with a horizontal guide plate). The folding of the web 101 and the formation of the gusset 136 can be similar to the formation of the pouch 48 and the gusset 52 as shown in FIGS. 14-16 of the incorporated-by-reference '435 Application. The folded web 101 and the gusset 136 could be otherwise formed without departing from the disclosure.

Figure 12:
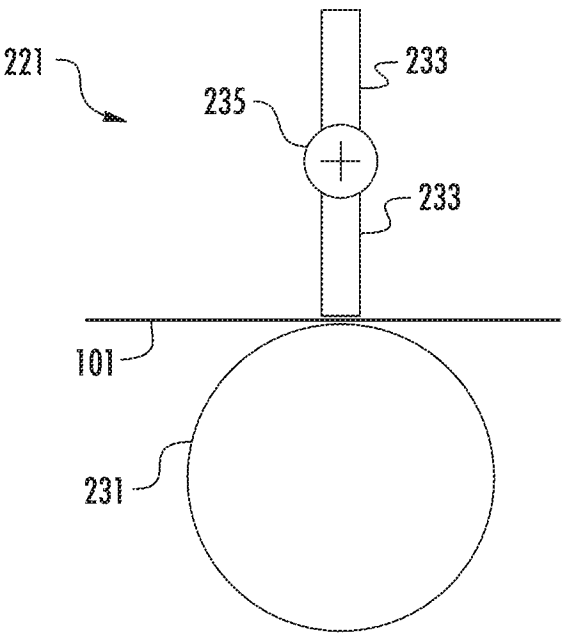
FIG. 12 is a schematic elevation view of the heat sealer of the system of FIG. 11.

The web 101 moves through a rotary heat sealer assembly 221 that is downstream from the bottom gusset forming assembly 220. The rotary heat seal assembly 221 forms the heat sealed side portions 130 of each bag formed in the web 101. The rotary heat sealer assembly 221 bonds overlapped portions of the web of material 101 to from the sealed side portions 130 of the bag 3 such as by pressing the seal areas 115 (FIG. 2) between heated elements. FIG. 12 schematically shows one embodiment of the rotary heat seal assembly 221, which includes two heating elements 233 mounted on an axle 235 above a roller 231. As the folded web of material 101 passes between the heating elements 233 and the roller 231, the heating elements 233 rotate on the axle 235 to periodically press the web of material against the roller 231. The heating elements 233 are heated so that the combination of pressure between the heating element 233 and the roller 231 and the heat of the heating element on the web of material 101 can cause the layers of the folded web 101 to seal together (e.g., by at least partially softening or melting the four plies of material at the sides of the gusset 136 together and the two plies of material at the sides of the bag portion above the gusset together). In one embodiment, the face of each heating element 233 (not shown) can be shaped to correspond to the shape of the heat sealed area 130 (FIGS. 3 and 4). The spacing of the heating elements 233 and the rotation of the axle 235 can be configured so that the heat sealed areas 130 are formed in the web 101 in intervals corresponding to the length of the bag portions 3' (e.g., so that the heat seal areas extend along the marginal side portions of the bag portions). The heat seal assembly 221 could include any suitable number of heating elements 233, and the roller 231 could be replaced by a flat plate or other surface for opposing the pressure of the heating elements without departing from the disclosure. In one embodiment, the heating elements 233 could be mounted on a heat seal roller or other feature.

Figure 13A:
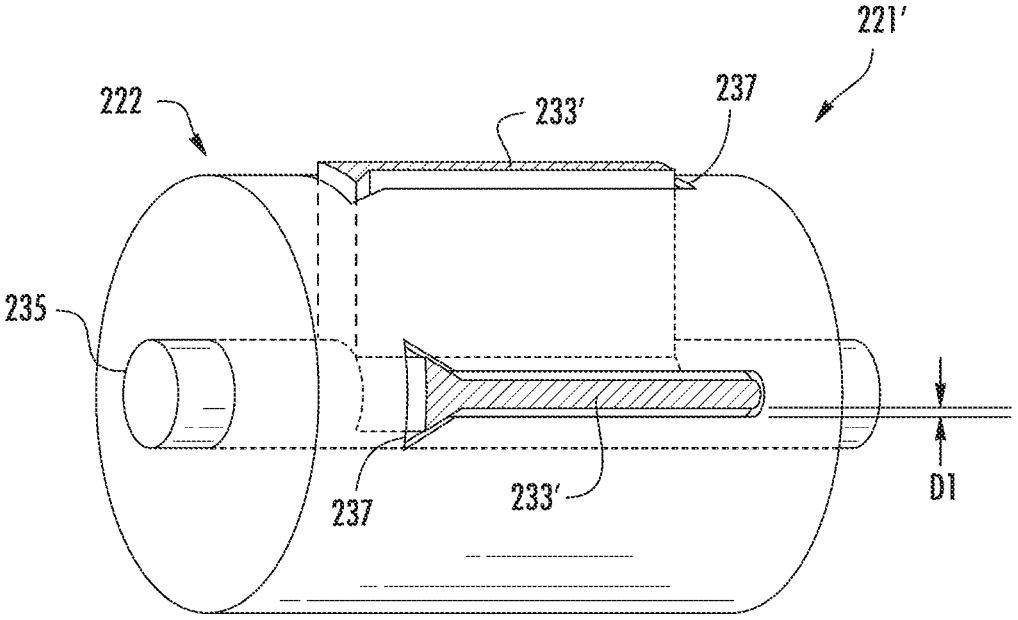
FIG. 13A is a schematic perspective view of an alternative heat sealer according to the exemplary embodiment of the disclosure.
Figure 13B:
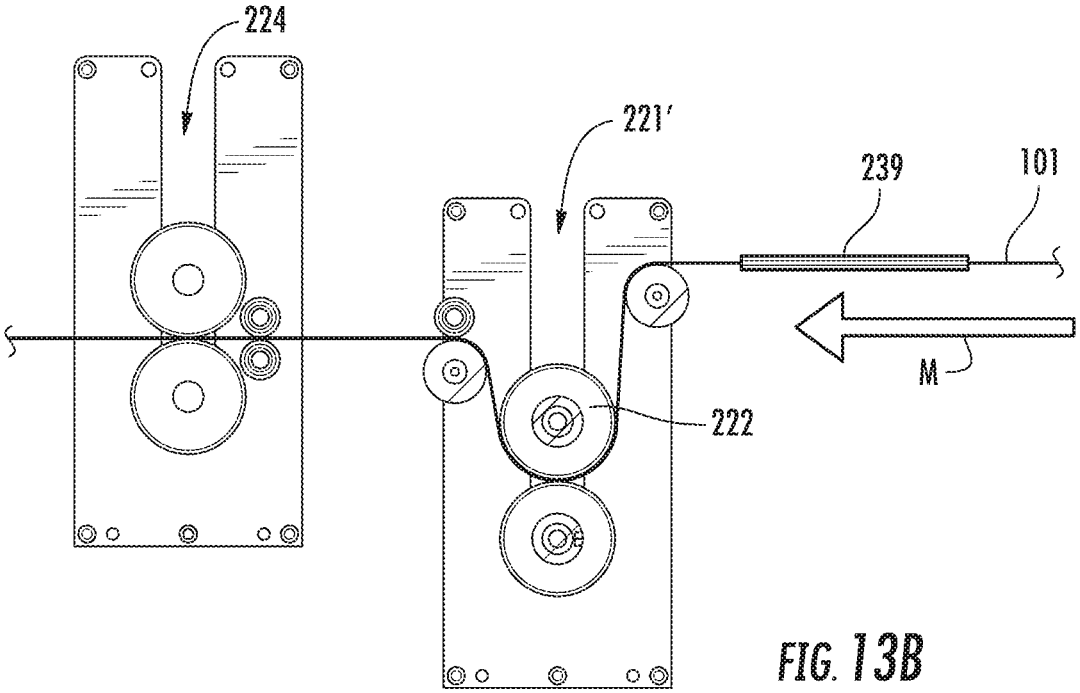
FIG. 13B is a schematic elevation view of the alternative heat sealer of FIG. 13A.

In an alternative embodiment shown in FIGS. 13A and 13B, the heat seal assembly 221' includes a plurality of heating elements 233' and a heat seal roller 222 mounted to the axle 235. As shown in FIG. 13A, the heating elements 233' can extend in respective gaps 237 in the heat seal roller 222 so that each of the heating elements is generally spaced apart from the heat seal roller by a distance D1 around its perimeter. Accordingly, the heating elements 233' generally do not heat up the heat seal roller 222 to help reduce the heating and/or sealing of the bag portions 3' outside the heat sealed areas 130. The heating elements 233' generally can be longer than the radius of the heat seal roller 222 so that the heating elements extend past the outer surface of the heat seal roller, and the faces of the heating elements can be shaped like the heat sealed areas 130 in the bag portions 3' (see FIG. 3) as shown in FIG. 13A. FIG. 13A shows only two heating elements 233' in the heat seal roller 222; however, any suitable number of heating elements 233' could be included in any suitable spacing around the axle 235.

As shown in FIG. 13B, the heat seal roller 222 can be positioned below the plane of the web 101 moving into and out of the heat seal assembly 221' so that the web 101 extends over a guide roller and downwardly along the surface of the heat seal roller on the upstream side of the roller. The web 101 then extends around the bottom of the heat seal roller 222 and up the downstream side of the roller over another guide roller. Accordingly, the portions of the web 101 that are sealed to form the heat sealed areas 130 are in contact with the respective heating elements 233' for a longer time than when the web 101 moves straight through the assembly. Stated another way, moving the heat seal roller downwardly and including guide rollers can increase the dwell time that the heat sealed areas 130 are in contact with the heating elements 233', which can help improve heat sealing of the web. Similarly, moving the heat seal roller 222 above the plane of the web 101 can increase dwell time. As the web 101 moves along the heat seal roller 222, the unsealed areas of the bag portions 3' outside the heat sealed areas 130 can engage the outer surface of the heat seal roller 222, which can be cooler that the heating elements 233' that engage the heat sealed areas 130.

In one embodiment, as shown in FIG. 13B, a preheater 239 can generally warm the web 101 prior to moving the web through the heat seal assembly 221' or the heat seal assembly 221 to help reduce the amount of dwell time needed for forming the heat sealed areas 130. The heat seal assemblies 221, 221' could be omitted or could be otherwise arranged, shaped, positioned, or configured without departing from the disclosure. In addition, the heat sealer assembly could be similar to the rotary bag sealer assembly disclosed in incorporated-by-reference '103 U.S. Provisional Patent Application and/or the '435 U.S. Provisional Patent Application.

As shown in FIG. 11, the heat-sealed web 101 passes from the heat sealer assembly 221 through a perforating station 224 that forms a line of weakening 117 between adjacent bag portions 3' of the web 101 that form respective bags 3. In one embodiment, the line of weakening 117 can be a perforation or tear line having connecting nicks to allow the bag portions 3' to stay connected in the web 101 as the web is attached to the blanks 10. The perforating station 224 could be a rotating perforator or otherwise configured without departing from the disclosure. For example, the perorating station 224 could include a perforator roller 241 and an opposing roller 243 as schematically shown in FIG. 11. The perforator roller 241 can include cutting edges 245 that form spaced cuts in the web 101 (e.g., along the centerline of each of the heat sealed areas 130, transverse to the machine direction M). Accordingly, the bag portions 3' can be separable from one another by tearing along the respective perforation lines 117. The system 200 then can move the series 125 of bag portions 3' from the web forming section 260 downstream to be attached to constructs 10.

In one embodiment, a carton feeder 207 of the system 200 includes a stack 208 of constructs (e.g., carton blanks 10) that are feed to a blank conveyor 209 of an attachment assembly 262. In the illustrated embodiment of FIG. 11, the web forming portion 260 is illustrated as being located upstream of the carton feeder 207, but the web forming portion 260 and components (e.g., bottom gusset forming assembly 220, rotary heat seal assembly 221, and perforating station 224) could be otherwise located, such as being located above, below, or transverse to the blank conveyor 209, and/or being located towards the downstream end 205 of the system 200, without departing from the disclosure. The blank conveyor 209 moves the constructs 10 in the machine direction M towards the web 101 of bag material that is fed from the perforating station 224. In one embodiment, the carton feeder could be any conventional carton feeder assembly such as a pick and place type carton feeder, or a belt driven carton feeder that conveys a construct 10 from the stack at relatively higher speeds than the pick and place type carton feeder. The carton feeder could comprise other types of feeders such as mechanisms that convey constructs 10 directed from a blank cutting station, or any other suitable types of feeders or other mechanisms without departing from the disclosure. For example, the system 200 could include inline printing machines and processes that print graphics and/or other features on the roll of paperboard material and die cutters or other cutting machines and processes that cut the printed roll directly into constructs 10 that are directly fed from the die cutters to the blank conveyor 209. Other process and apparatus for processing the constructs 10 could be included without departing from the scope of this disclosure.

As shown in FIG. 14, the blank conveyor 209 includes a lugged belt 211 for engaging a series of constructs 10 and conveying the constructs in the machine direction M. In one embodiment, the constructs 10 are conveyed in a manner where respective adjacent constructs are overlapped. For example, as shown in FIGS. 14 and 15, each construct 10 is placed on the conveyor so that it partially overlaps a previously-placed, downstream construct 10, such as with the side panel 29, the front panel 21, and the bottom panel 52 of the upstream construct at least partially overlapping the respective side panel 28, back panel 23, and bottom panel 51 of the downstream construct. Each of the constructs 10 can be pushed in the machine direction M by respective lugs 213 of the lug belt 211 (FIGS. 14 and 15). The constructs 10 could be otherwise placed and/or arranged on the conveyor 209 and/or the conveyor 209 could be otherwise configured without departing from the scope of the disclosure.

As shown in FIGS. 11 and 14, the attachment assembly 262 can include an adhesive applicator 216 disposed downstream of the carton feeder 207 and can apply adhesive to the constructs 10 prior to attachment to the web 101. For example, the adhesive applicator 216 can apply glue strips G to the front panel 21 of each of the constructs 10 (FIG. 15), wherein the front panel 21 of each construct generally is not overlapped by the adjacent upstream construct. The web 101 is brought into contact with the constructs 10 by a compression nip roll 217 of the attachment assembly 262 so that each respective bag portion 3' is adhesively attached to a respective construct 10. In one embodiment, an opposing roller or other suitable opposing surface (not shown) can be disposed opposite to the nip roll 217 so that the constructs and the bag portions are nipped between the nip roll and the opposing surface. In the illustrated embodiment, each bag portion 3' of the web 101 is adhesively attached to the front panel 21 of a respective blank 10, but the bag portion 3' could be otherwise attached to the blank. At this point in the assembly process, the web 101 is attached to the series of constructs 10, such that the web can be referred to as an attached web 101'. Each respective adjacent bag portion 3' of the attached web 101' is attached to a respective construct 10 of the series of constructs that are overlapped at this point of the assembly process (after attachment of the web 101 to the constructs 10 by the compression nip roll 217).

Figure 17:
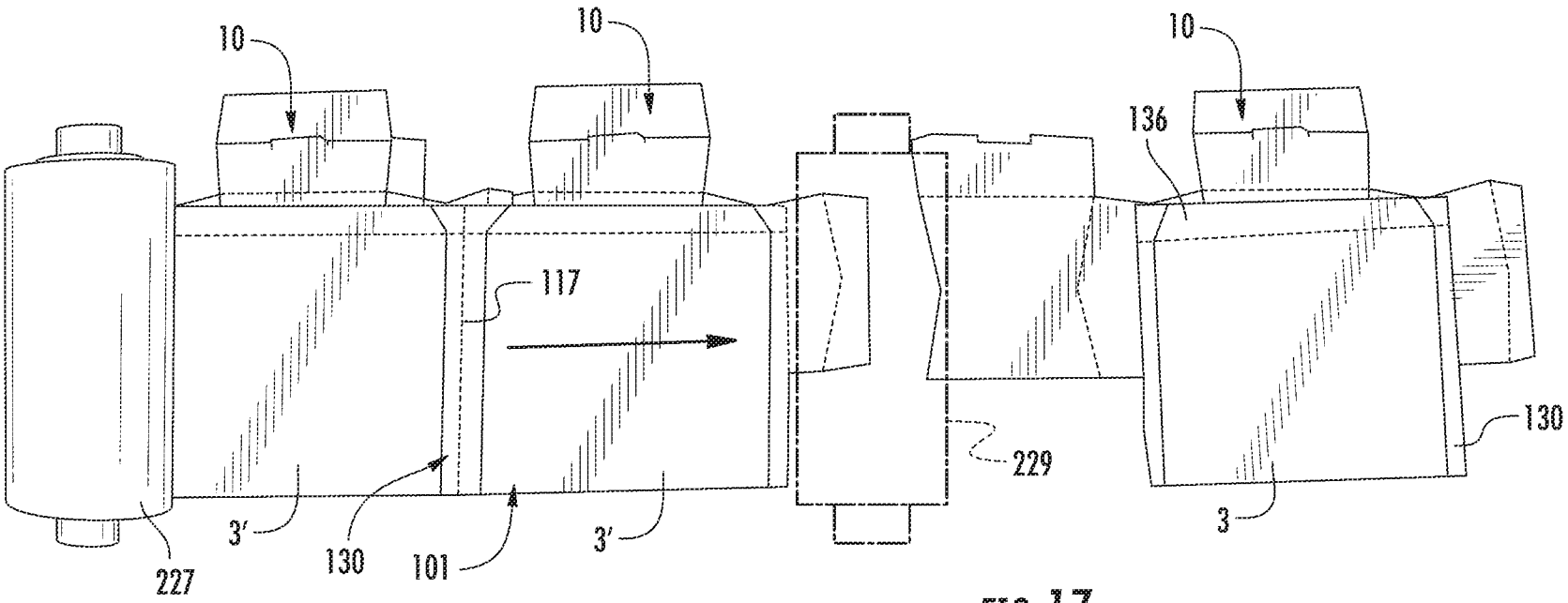
FIG. 17 is a schematic top view showing a faster downstream roller moving the blank and the bag faster than the other blanks and the web so that the bag is separated from the web according to the exemplary embodiment of the disclosure.

As shown in FIGS. 14, 16, and 17, the attached web 101' and the overlapped constructs, are separated at a separating station 225 that is downstream of the compression roll 217. In one embodiment, the separation station 225 includes a first (upstream) roller 227 that conveys the attached web 101' and the constructs 10 at a first speed and a second (downstream) roller 229 that rotates at a second speed that is faster than the first speed. In the illustrated embodiment, each of the rollers 227, 229 is positioned above a respective opposing roller 230. In one embodiment, the lugs 213 of the lug belt 211 push the constructs 10 to the upstream roller 227, which continues to move each subsequent construct 10 with its attached bag portion 3' toward the downstream roller 229. When the attached web 101' is accelerated by the faster rotational speed of the second roller 229, the bag portion 3' engaging the downstream roller 229 is pulled away from the respectively adjacent upstream bag portion 3' of the web 101 and separates therefrom at the line of weakening 117. In one embodiment, any two bag portions 3' (e.g., two adjacent bag portions 3') can be considered an upstream bag portion 3' and a downstream bag portion 3'. For example, the bag portions 3' engaging the respective upstream roller 227 and downstream roller 229 at a given time can be considered an upstream bag portion and a downstream bag portion, respectively. Accordingly, the bag portion 3' accelerated by the downstream roller 229 with the attached construct 10 becomes an individual bag 3 attached to the construct (FIGS. 4, 14, and 17). The faster speed of the second roller 229 effectively pulls and separates each bag portion 3' from the remainder of the web 101 along the line of weakening 117 so that the construct 10 and bag 3 are separated from the attached web 101'. In one embodiment, slower speed of the upstream roller 227 can cause the upstream roller to effectively retain the attached web 101' against the pull of the downstream roller 229 on the construct 10 and the bag 3 as the bag is separated from the web. In one example, the first speed of the first roller 227 can be in the range of approximately 250-300 feet per minute, and the second speed of the second roller 229 can be in the range of approximately 350-450 feet per minute. The first and second speeds can be any suitable speed for separating the attached web 101' into separated blanks 10 and bags 3 without departing from the disclosure. Further, the separation station 225 could be otherwise arranged and configured and could include other suitable components to separate the attached web in a different or alternative manner without departing from the disclosure.

In one embodiment, the separated individual blanks 10 and attached bags 3 are conveyed downstream of the separation assembly 225 to a folder/gluer carton forming assembly (not shown). In one embodiment the carton forming assembly includes a series of folders that position the various flaps and panels of the blank 10 to form the flat cartons 5 (FIG. 6) that can be packaged and shipped for filling with product. Alternatively, the combination of the blank 10 with the attached bag 3 can be transferred to a separate folder/gluer system and/or the packages 152 can be manually erected. Other collection, conveying, or discharge mechanisms can be included in the system 200 without departing from this disclosure.

The system 200 for forming the bags 3 and attaching the bags 3 to respective constructs, which can form the reinforced packages 152 of the present disclosure form the packages in a highly efficient manner by first forming the web 101 have a series of bag portions 3' that are attached to a respective blank 10 to form the attached web 101'. In one embodiment, the attached web is then separated to form the individual blanks 10 having a bag 3 attached thereto. The blanks 10 can be then further folded and glued to form the cartons 5 having the bags 3 therein. The system 200 includes conveying and partially overlapping of the blanks 10 and attachment of the overlapped blanks to the web 101 including the formed bag portions 3'. The system 200 can integrate the bag 3 forming in-line with the combining, folding, and gluing of the blank 10 to form the carton 5. The system 200 includes the process wherein web folding, sealing, and combining speed (feet per minute) is minimized while maintaining output in terms of pieces per minute. The web 101 of bag material is maintained in a continuous, connected fashion until after the web and the blanks 10 are combined and adhered together. This can help to minimize misalignment issues between the bags 3 and the blanks 10. After the web 101 and blanks 10 are combined and adhered together in proper alignment, they are separated then stored, transferred, and/or processed through a folding/gluing assembly.

Generally, as described herein, liners can be formed from a paper stock material, although various plastic or other liner materials also can be used, and can be lined or coated with a desired material. The constructs, blanks, and/or reinforcing sleeves described herein can be made from a more rigid material such as a clay-coated natural kraft ("CCNK"). Other materials such as various card-stock, paper, plastic or other synthetic or natural materials also can be used to form the components of the packages described herein.

In general, the blanks of the present disclosure may be constructed from paperboard having a caliper so that it is heavier and more rigid than ordinary paper. The blank can also be constructed of other materials, such as cardboard, or any other material having properties suitable for enabling the carton to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments. Additionally, the disclosure shows and describes only selected embodiments, but various other combinations, modifications, and environments are within the scope of the disclosure as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A method of at least partially forming a reinforced package, the method comprising:

moving a web of material in a downstream direction through a web forming section;

at least partially forming at least a series of bag portions in the web of material during the moving the web of material through the web forming section;

feeding a plurality of constructs sequentially onto a conveyor, the conveyor moving the constructs of the plurality of constructs toward a nip roller, wherein the feeding the plurality of constructs sequentially onto the conveyor comprises forming a plurality of partially overlapped constructs on the conveyor and moving the plurality of partially overlapped constructs toward the nip roller with the conveyor;

forming an attached web by engaging and adhering the partially overlapped constructs of the plurality of partially overlapped constructs with respective bag portions of the series of bag portions of the web of material with the nip roller;

moving the attached web through a separating station, the moving the attached web comprising moving the partially overlapped constructs of the plurality of partially overlapped constructs with the web of material;

separating a bag portion of the series of bag portions from a remainder of the web of material to form a bag during the moving the attached web through the separating station, the bag being attached to a construct of the plurality of constructs.

2. The method of claim 1, wherein the separating the bag portion from the remainder of the web of material comprises accelerating the bag portion with respect to the remainder of the web of material.

3. The method of claim 2, wherein the separating station comprises an upstream roller and a downstream roller, the accelerating the bag portion with respect to the remainder of the web of material comprising engaging at least one of the construct and the bag portion with the downstream roller while an adjacent portion of the remainder of the web of material engages the upstream roller and rotating the downstream roller faster than the upstream roller.

4. The method of claim 1, wherein the bag portion is a downstream bag portion that is separable from an upstream bag portion of the series of bag portions in the web of material along a line of weakening.

5. The method of claim 4, wherein the separating station comprises an upstream roller and a downstream roller, the separating the bag portion of the series of bag portions from the remainder of the web of material comprising engaging at least one of the constructs and the downstream bag portion with the downstream roller while the upstream roller engages the upstream bag portion and rotating the downstream roller faster than the upstream roller to pull the downstream bag portion away from the upstream bag portion.

6. The method of claim 4, wherein the at least partially forming at least the series of bag portions further comprises folding a first web portion to at least partially overlap a second web portion, forming a heat sealed area in the upstream bag portion and the downstream bag portion by heat sealing at least a portion of the first web portion and the second web portion to one another, and forming the line of weakening between the upstream bag portion and the downstream bag portion along at least a portion of the heat sealed area.

7. The method of claim 6, wherein the at least partially forming at least the series of bag portions further comprises folding a gusset portion inwardly between the first web portion and the second web portion during the folding the first web portion to at least partially overlap the second web portion.

8. The method of claim 6, wherein the heat sealing at least a portion of the first web portion and the second web portion to one another comprises moving a heating element into engagement with at least one of the first web portion and the second web portion during the moving the web of material through the web forming section.

9. The method of claim 8, wherein the moving the heating element comprises rotating the heating element on an axle.

10. The method of claim 6, wherein the forming the line of weakening comprises engaging the web of material with a rotating perforator to form a tear line in the web of material.

11. The method of claim 1, wherein the at least partially forming at least the series of bag portions comprises folding a first web portion to at least partially overlap a second web portion and forming a plurality of heat sealed areas in the web of material, each heat sealed area of the plurality of heat sealed areas at least partially extending along a marginal portion of each of two respectively adjacent bag portions of the series of bag portions.

12. The method of claim 11, wherein the forming the plurality of heat sealed areas comprises periodically engaging a heating element with the web of material during the moving the web of material through the web forming section.

13. The method of claim 12, wherein a heat seal assembly comprises the heating element and an axle, the heating element is mounted on the axle, and the periodically engaging the heating element with the web of material comprises rotating the heating element on the axle as the web of material is moved through the web forming section.

14. The method of claim 13, wherein the heat seal assembly comprises a heat seal roller mounted to the axle, the heating element extending through at least a portion of the heat seal roller to an exterior of the heat seal assembly, an outer surface of the heat seal roller engaging at least a portion of an unsealed area of at least one of the first web portion and the second web portion as the web of material is moved through the web forming section.

15. The method of claim 14, wherein the moving the web of material through the web forming section comprises moving the web of material downwardly along at least one of the heating element and the outer surface of the heat seal roller on an upstream side of the heat seal assembly and upwardly along the at least one of the heating element and the outer surface of the heat seal roller on a downstream side of the heat seal assembly.

16. The method of claim 14, wherein the heat seal roller comprises a gap extending at least partially around the heating element so that the heat seal roller is free from contact with the heating element.

17. The method of claim 11, wherein the at least partially forming at least the series of bag portions further comprises forming a plurality of lines of weakening in the web of material, each line of weakening of the plurality of lines of weakening extending along a respective heat sealed area of the plurality of heat sealed areas so that each bag portion of the series of bag portions is separable from an adjacent bag portion along a respective one of the lines of weakening.

18. The method of claim 1, wherein the forming an attached web by engaging and adhering the partially overlapped constructs of the plurality of partially overlapped constructs with respective bag portions of the series of bag portions comprises applying glue to each construct of the plurality of constructs prior to engaging the partially overlapped constructs of the plurality of partially overlapped constructs with the respective bag portions.

19. The method of claim 1, wherein the forming the plurality of partially overlapped constructs on the conveyor comprises placing a first construct on the conveyor and placing a second construct on the conveyor, the first construct comprises a first front panel, a first side panel foldably connected to the first front panel, and a first back panel foldably connected to the first side panel, the second construct comprises a second front panel, a second side panel foldably connected to the second front panel, and a second back panel, the placing the second construct on the conveyor comprises positioning the second front panel of the second construct to at least partially overlap at least the first back panel of the first construct and positioning the second side panel of the second construct to at least partially overlap at least the first side panel of the first construct, and the engaging and adhering the partially overlapped constructs of the plurality of partially overlapped constructs with respective bag portions of the series of bag portions of the web of material with the nip roller comprises engaging the first front panel with a first bag portion of the series of bag portions and then engaging the second front panel with a second bag portion of the series of bag portions.

20. A system for at least partially forming reinforced packages, the system comprising:

a web forming section receiving a web of material for at least partially forming at least a series of bag portions in the web of material;

a carton feeder for feeding a plurality of constructs onto a conveyor, the carton feeder being for depositing constructs of the plurality of constructs onto the conveyor to form a plurality of partially overlapped constructs on the conveyor, and the conveyor is for moving at least the plurality of partially overlapped constructs to engagement with the web of material;

an attachment assembly for engaging and adhering the partially overlapped constructs of the plurality of partially overlapped constructs with respective bag portions of the series of bag portions of the web of material with a nip roller to form an attached web; and a separating station for receiving the attached web and separating a bag portion of the series of bag portions from a remainder of the web of material to form a bag attached to a construct of the plurality of constructs.

21. The system of claim 20, wherein the separating station comprises an upstream roller and a downstream roller, the downstream roller being for being rotated faster than the upstream roller.

22. The system of claim 20, wherein the attachment assembly is disposed downstream from the web forming section, and the separating station is disposed downstream from the attachment assembly.

23. The system of claim 20, wherein the web forming section comprises a heat sealer assembly for forming heat sealed areas along marginal portions of the bag portions of the series of bag portions in the web of material, the heat sealer assembly comprising at least a heating element.

24. The system of claim 23, wherein the heating element is mounted on an axle for rotating the heating element about the axle so that the heating element periodically engages the web of material to form the heat sealed areas.

25. The system of claim 24, wherein a heat seal roller is mounted on the axle for rotating the heat seal roller about the axle with the heating element, and the heat seal roller comprises a gap extending at least partially around the heating element so that the heating element generally is free from contact with the heat seal roller.

26. The system of claim 25, wherein the heat seal roller is displaced downwardly with respect to a plane of the web of material extending from the heat seal assembly.

* * * * *